US006576387B2

(12) United States Patent
Hashizume et al.

(10) Patent No.: US 6,576,387 B2
(45) Date of Patent: Jun. 10, 2003

(54) IMAGE-FORMING APPARATUS AND IMAGE-FORMING METHOD

(75) Inventors: Junichiro Hashizume, Shizuoka (JP); Ryuji Okamura, Shizuoka (JP); Kazuto Hosoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 09/987,228

(22) Filed: Nov. 14, 2001

(65) Prior Publication Data

US 2002/0115012 A1 Aug. 22, 2002

(30) Foreign Application Priority Data

Nov. 15, 2000 (JP) ..... 2000-348142

(51) Int. Cl.[7] ..... G03G 15/04
(52) U.S. Cl. ..... 430/66; 430/126; 399/159
(58) Field of Search ..... 430/126, 66; 399/159

(56) References Cited

U.S. PATENT DOCUMENTS 5,579,095 A 11/1996 Yano et al. ..... 355/219
6,134,407 A 10/2000 Ishiyama et al. ..... 399/174

FOREIGN PATENT DOCUMENTS

EP 1 058 157 12/2000
JP 63-208878 8/1988
JP 8-6353 1/1996
JP 10-307454 11/1998
JP 11-184121 7/1999

OTHER PUBLICATIONS

U.S. patent application No. 09/987,507, filed Nov. 15, 2001.

*Primary Examiner*—Mark A. Chapman
(74) *Attorney, Agent, or Firm*—Fitzpatrick, Cella, Harper & Scinto

(57) ABSTRACT

In an image-forming apparatus having at least i) an electrophotographic photosensitive member having at least a photoconductive layer and a surface layer on a conductive substrate, ii) a developing means having a toner, and iii) a charging means, the photoconductive layer comprises a non-single-crystal material composed chiefly of silicon, the surface layer comprises a non-single-crystal carbon film containing at least hydrogen and has a dynamic hardness in the range of from $4.90\times10^9$ to $1.76\times10^{10}$ Pa (500 to 1,800 kgf/mm$^2$), the charging means has a charging member kept in contact with the electrophotographic photosensitive member, forming a contact zone therewith, charges the electrophotographic photosensitive member electrostatically upon application of a voltage, and the toner is a magnetic toner having toner particles containing at least a binder resin and a magnetic material, and an inorganic fine powder, having an average circularity of from 0.950 to 1.000, and having a saturation magnetization of from 10 to 50 Am$^2$/kg (emu/g) under application of a magnetic field of 79.6 kA/m (1,000 oersteds). Also disclosed is an image-forming method.

27 Claims, 5 Drawing Sheets

IMAGE-FORMING APPARATUS AND IMAGE-FORMING METHOD

BACKGROUND OF THE INVENTION

1. Field of the Invention

This invention relates to an image-forming apparatus and an image-forming method which make use of an amorphous-silicon electrophotographic photosensitive member, a contact charging means and a spherical toner.

2. Related Background Art

As techniques for element members used in electrophotographic photosensitive members, proposals are made on various materials such as selenium, cadmium sulfide, zinc oxide, phthalocyanine and amorphous silicon (hereinafter "a-Si"). In particular, non-single-crystal deposited films containing silicon atoms as a chief component as typified by a-Si films and also amorphous deposited films formed of a-Si compensated with. e.g., hydrogen and/or a halogen (such as fluorine or chlorine) have been proposed for high-performance, high-durability and environmental-pollution-free photosensitive members, and some of them have been put into practical use.

In recent years, under circumstances where electrophotographic apparatus are demanded to be made more and more high-performance, electrophotographic apparatus making use of a-Si are also demanded to achieve higher image quality and higher resolution than ever.

Conventionally, it is common to use corona charging assemblies in charging units for photosensitive members used in, e.g., plain-paper copying machines, laser beam printers, LED printers and liquid-crystal shutter printers, and such corona charging assemblies are in wide use. The corona charging assemblies charge object members electrostatically by applying a high voltage of about 5 to 10 kV to a metal wire of about 50 to 100 $\mu$m in diameter to ionize the atmosphere.

For structural reasons, the corona charging assemblies have a disadvantage that generation of ozone in a large quantity accompanies corona discharging. With their repeated used, ozone and corona products may become deposited on the photosensitive member surface, under the influence of which the photosensitive member surface may become susceptible to humidity to tend to absorb moisture content. This may cause a lateral flow of electric charges on the photosensitive member surface in an environment of high temperature and high humidity to cause a lowering of image quality which is called smeared images. There is such a problem. In particular, the electrophotographic photosensitive members making use of a-Si have so high a surface hardness that. while they are durable to printing on a large number of sheets, their surfaces may abrade with difficulty. Hence, corona products having once adhered can be removed with difficulty to have a great influence.

As another problem of corona charging assemblies, they tends to be affected by any uneven layer thickness and resistance distribution of the photosensitive member. This may cause unevenness in surface potential, and may consequently cause uneven density on images.

In order to solve such a problem on image quality, various charging units are proposed.

In a contact charging unit as disclosed in Japanese Patent Application Laid-open No. 63-208878, a charging member to which a voltage is kept applied is brought into contact with an object member to be charged (photosensitive member), which is called charging object member, to charge the photosensitive member surface to an intended potential. Compared with the corona charging assemblies, such a unit can achieve a low voltage in respect of the applied voltage necessary for providing the desired potential on the charging object member surface, and does not cause any smeared images due to the ozone products because the quantity of ozone occurring in the course of charging is zero or is very small. Also, in such contact charging, the surface of the photosensitive member is charged to have substantially a uniform potential in accordance with the applied voltage, and hence uneven image density may little occur. It has such advantages.

In the way of progress such that a series of contact charging members are improved in various manners. as disclosed in Japanese Patent Application Laid-open No. 8-6353, a mechanism is proposed in which a contact charging member making use of particles in the form of a magnetic brush comprised of a magnetic material and magnetic particles (or powder) is brought into contact with an electrophotographic photosensitive member to provide it with charge. Also proposed is, as disclosed in Japanese Patent Application Laid-open No. 10-307454, a new method of a mechanism in which a carrying member having conductivity and elasticity so constructed that charged particles are carried on the surface is brought into contact with a photosensitive member to provide it with charge.

Attempts to achieve much higher image quality are also made from improvements of toners. More specifically, polymerization toners are on studies in place of conventional pulverization toners.

The polymerization toners have superior fluidity because they have particles in substantially a uniform spherical shape and having less scattering in particle diameter, Also, they are advantageous to the achievement of high image quality because they do not let colorants come bare to particle surfaces and have uniform triboelectric chargeability. Still also, they can enclose wax in particles, and can attain good fixing performance and anti-offset properties. Hence, the polymerization toners are being gradually widely employed in high-image-quality machines. As a patent application which proposes a magnetic polymerization toner, EP1058157 A1 is accessible.

As stated above, attempts to achieve much higher image quality are being made by combining the formation of uniform latent images free of any unfocused or uneven images that is attributable to contact charging units with the formation of faithful visible images that is attributable to polymerization toners.

However, in the case of high-image-quality image-forming apparatus in which uniform latent images are formed by utilizing the voltage application type contact charging unit as a means for charging the electrophotographic photosensitive member and the latent images are rendered visible by the use of the polymerization toner that can perform highly precise development as stated above, there are the following problems.

That is, in such a contact charging unit, it has very good charge potential uniformity when viewed microscopically as stated above. However, when viewed microscopically, for the reasons of its construction, marks of contact of the magnetic brush or charged particles with the photosensitive member (brush images) may appear. Such brush images appear at halftone image areas. and hence it makes image quality very poor even when the polymerization toner is used.

In order to prevent such brush images, it is necessary to make higher the relative speed between the charging unit and the photosensitive member to make them rub against each other in a greater extent so that the charging unit can be brought into uniform contact with the electrophotographic photosensitive member. However, because of such rubbing, the surface of the photosensitive member may abrade or wear, though slightly. Although such wear is at a small level, even microscopic abrasion may have a great influence when it lasts over a long period time, because the a-Si photosensitive member has a long lifetime originally.

As another problem other than such uneven charging, there is also a problem that the contact charging units deteriorate. For example, in the case of a magnetic-brush type contact charging assembly, its magnetic particles may migrate to the electrophotographic photosensitive member side, which is a problem of what is called magnetic-particle leakage. In the case of an elastic-roller type contact charging assembly, there is a problem that its roller may wear or deform. Once the contact charging unit has deteriorated in this way, faulty charging may occur or image deterioration may occur. Hence, this provides a subject on how the contact charging units be made to have long lifetime.

Many proposals are also made on the improvement of photosensitive members themselves. As a patent application concerning an a-Si photosensitive member having a surface layer formed of a non-single-crystal carbon film, Japanese Patent Application Laid-open No. 11-184121 is accessible.

SUMMARY OF THE INVENTION

An object of the present invention is to provide an image-forming apparatus and an image-forming method which have solved the above problems.

Stated more specifically, an object of the present invention is to provide an image-forming apparatus and an image-forming method which make use of an a-Si photosensitive member and promise a high image quality, having been improved in contact performance although the abrasion level of the photosensitive member surface is reduced.

Another object of the present invention is to provide an image-forming apparatus and an image-forming method which are able to obtain high-quality images free of any unfocused images and smeared images in every environment, without causing any generation of ozone products due to corona discharging.

Still another object of the present invention is to provide an image-forming apparatus and an image-forming method in which the a-Si photosensitive member can uniformly be charged to obtain uniform images free of any uneven images and also free of any brush images or coarse images in halftone images.

A further object of the present invention is to provide an image-forming apparatus and an image-forming method which are able to obtain sharp images in a high resolution.

A still further object of the present invention is to provide an image-forming apparatus and an image-forming method in which the a-Si photosensitive member does not wear and operates stably over a long period of time.

A still further object of the present invention is to provide an image-forming apparatus and an image-forming method in which the contact charging unit has a long lifetime and images can stably be obtained at a low maintenance cost and over a long period of time.

The present invention provides an image-forming apparatus comprising:

an electrophotographic photosensitive member having a conductive substrate, and at least a photoconductive layer and a surface layer on the conductive substrate;

a charging means for charging the electrophotographic photosensitive member electrostatically;

a latent-image-forming means for performing imagewise exposure to form an electrostatic latent image on the electrophotographic photosensitive member;

a developing means for moving a toner to the electrostatic latent image formed on the electrophotographic photosensitive member, to render the electrostatic latent image visible to form a toner image; and a transfer means for transferring the toner image to a transfer medium;

wherein;

the photoconductive layer of the electrophotographic photosensitive member comprises a non-single-crystal material composed chiefly of silicon;

the surface layer of the electrophotographic photosensitive member comprises a non-single-crystal carbon film containing at least hydrogen, and has a dynamic hardness in the range of from $4.90\times10^9$ to $1.76\times10^{10}$ Pa (500 to 1,800 kgf/mm$^2$);

the charging means has a charging member kept in contact with the electrophotographic photosensitive member, forming a contact zone therewith, and is a charging means for charging the electrophotographic photosensitive member electrostatically upon application of a voltage; and the toner is a magnetic toner having toner particles containing at least a binder resin and a magnetic material, and an inorganic fine powder, and having an average circularity of from 0.950 to 1.000;

the toner having a saturation magnetization of from 10 to 50 Am$^2$/kg (emu/g) under application of a magnetic field of 79.6 kA/m (1,000 oersteds).

The present invention also provides an image-forming method comprising:

a charging step of electrostatically charging an electrophotographic photosensitive member having a conductive substrate, and at least a photoconductive layer and a surface layer on the conductive substrate;

a latent-image-forming step of forming an electrostatic latent image on the electrophotographic photosensitive member by imagewise exposure;

a developing step of moving a toner to the electrostatic latent image formed on the electrophotographic photosensitive member, to render the electrostatic latent image visible to form a toner image; and a transfer step of transferring the toner image to a transfer medium;

wherein;

the photoconductive layer of the electrophotographic photosensitive member comprises a non-single-crystal material composed chiefly of silicon;

the surface layer of the electrophotographic photosensitive member comprises a non-single-crystal carbon film containing at least hydrogen, and has a dynamic hardness in the range of from $4.90\times10^9$ to $1.76\times10^{10}$ Pa (500 to 1,800 kgf/mm$^2$);

the charging step is a charging step of applying a voltage to a charging member kept in contact with the electrophotographic photosensitive member, forming a contact zone therewith, to charge the electrophotographic photosensitive member electrostatically; and the toner is a magnetic toner having toner particles containing at least a binder resin and a magnetic material, and an inorganic fine powder, and having an average circularity of from 0.950 to 1.000;

the toner having a saturation magnetization of from 10 to 50 $Am^2/kg$ (emu/g) under application of a magnetic field of 79.6 kA/m (1,000 oersteds).

DESCRIPTION OF THE PREFERRED EMBODIMENTS

Figure 1:
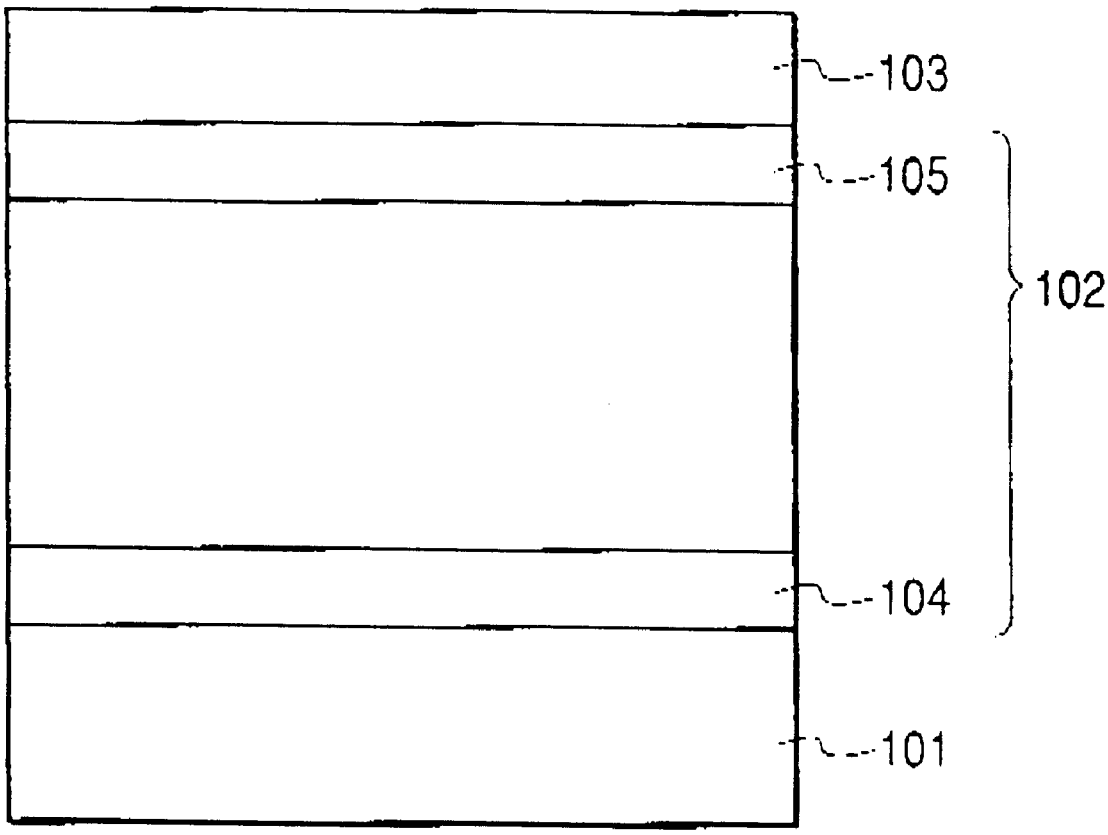
FIG. 1 is a diagrammatic sectional illustration of an example of an electrophotographic photosensitive member used in the image-forming apparatus of the present invention.

The present inventors have made extensive studies on achievement of higher image quality in image-forming apparatus making use of a-Si photosensitive members. As the result, they have reached a conclusion that it is effective to use a contact charging type charging assembly in order to be free of the smeared images and uneven charging that are questioned when the a-Si photosensitive member is charged by means of a corona charging assembly, and also to use a polymerization toner in combination in order to form sharp images in a high resolution.

Since, however, in the contact charging unit the marks of contact of the magnetic brush or charged particles with the photosensitive member, called brush images, may appear on images, the contact charging unit and the a-Si photosensitive member must be rubbed against each other at their relative speed made fairly higher. In such a case, in spite of the a-Si photosensitive member, having a high hardness, the photosensitive member surface may abrade when used over a long period of time.

To cope with these problems, extensive studies have been made on how the a-Si photosensitive member be made optimum. As the result, it has been found effective to use a non-single-crystal material containing at least hydrogen and composed chiefly of silicon, i.e., what is called hydrogenated amorphous carbon (hereinafter "a-C:H"). It has become clear that a-C:H films have a much higher hardness than those formed of any conventional materials, and hence can achieve a sufficiently long lifetime even when rubbed with a contact charging assembly.

The present invention has been accomplished on the basis of the above findings.

The image-forming apparatus of the present invention comprises an electrophotographic photosensitive member having a conductive substrate, and at least a photoconductive layer and a surface layer on the conductive substrate; a charging means for charging the electrophotographic photosensitive member electrostatically; a latent-image-forming means for performing imagewise exposure to form an electrostatic latent image on the electrophotographic photosensitive member; a developing means for moving a toner to the electrostatic latent image formed on the electrophotographic photosensitive member, to render the electrostatic latent image visible to form a toner image; and a transfer means for transferring the toner image to a transfer medium.

To obtain the effect of the present invention sufficiently, the surface layer of the photosensitive member may preferably have a dynamic hardness in the range of from $4.90\times10^9$ to $1.76\times10^{10}$ Pa (500 to 1,800 $kgf/mm^2$). In the sense that a sufficient latitude should be taken against wear resistance and film peeling, the surface layer may more preferably have a dynamic hardness in the range of from $6.86\times10^9$ to $1.47\times10^{10}$ Pa (700 to 1,500 $kgf/mm^2$).

In order for the surface layer of the photosensitive member to have a sufficient wear resistance against contact charging assemblies of various types used in image-forming apparatus, the intended effect can well be obtained as long as the surface layer has as its hardness a dynamic hardness of $4.90\times10^9$ (500 $kgf/mm^2$) or higher. On the other hand, if it has a dynamic hardness in a value greater than $1.76\times10^{10}$ Pa (1,800 $kgf/mm^2$), the film peeling may occur when the surface layer is superposed in a layer thickness large enough to exhibit satisfactory functions as the electrophotographic photosensitive member.

The a-C:H film has also an additional advantage that it brings about an improvement in lubricity of the surface. More specifically, when a magnetic bruch charging assembly is used as the contact charging unit, the magnetic-particle leakage may less occur. When an elastic roller is used, its contact surface may less come to have permanent set. Hence, the a-C:H film has a secondary effect that it can make the contact charging unit less deteriorate.

Meanwhile, in order to obtain images in a high resolution, it is effective to use a polymerization toner. The toner of this type has, on account of its production process, a substantially spherical particle shape compared with conventional toners produced from a resin by pulverization and classification, and also the toner has a uniform particle size distribution, and has a very good fluidity. Also, the polymerization toner makes its colorant come bare to particle surfaces with difficulty, and has uniform triboelectric chargeability, providing a little higher triboelectric charge potential. As the result, any minute latent images can faithfully be developed, bringing about the effect of improving resolution and sharpness.

Combination of this polymerization toner with the surface layer formed of the a-C:H film according to the present invention can remarkably improve the sharpness, compared with any conventional photosensitive members. The mechanism thereof is unclear in detail at present. It is presumed to be the fact that the a-C:H film has much lower surface free energy than films formed of materials such as amorphous silicon carbide, amorphous silicon nitride and amorphous silicon oxide which are conventionally used, and hence a synergistic effect combined with the particle shape of the polymerization toner has brought about further improvement in fluidity to make it easy to reproduce latent images faithfully.

As stated above, the present invention has made it possible for the first time to provide an image-forming apparatus which is not influenced by environment and promises high image quality and long lifetime by virtue of combination of three factors, the contact charging unit, the polymerization toner and the a-Si photosensitive member having the surface layer formed of a-C:H.

The present invention is specifically described below with reference to the drawings.

[1] Electrophotographic Photosensitive Member in the Present Invention

First, embodiments of the electrophotographic photosensitive member used in the image-forming apparatus and image-forming method of the present invention are described below with reference to the drawings.

FIG. 1 is a diagrammatic view for describing an embodiment of the electrophotographic photosensitive member used in the present invention.

Shown here is an electrophotographic photosensitive member comprising a conductive substrate 101 made of a conductive material as exemplified by aluminum or stainless steel, a photoconductive layer 102 provided on this conductive substrate, and a surface layer 103 as an outermost layer, which are superposed in order.

The photoconductive layer 102 contains at least hydrogen and/or a halogen and is formed of a non-single-crystal material (a-Si) composed chiefly of silicon. As the surface layer 103, a non-single-crystal carbon film (a-C:H film) is used.

The photoconductive layer 102 may further optionally be provided, in its interface with the surface layer 103, with a buffer layer 105 formed of, e.g., amorphous silicon carbide, amorphous silicon nitride or amorphous silicon oxide.

Between the photoconductive layer 102 and the conductive substrate 101, a lower-part blocking layer 104 may further be provided which blocks the injection of carriers from the conductive substrate 101 and also improves the adherence of the photoconductive layer 102. In the buffer layer 105 and the lower-part blocking layer 104, dopants such as Group 3B elements or group 5B elements may be incorporated under appropriate selection so that the polarity of charging, i.e., positive charging or negative charging can be controlled.

The photoconductive layer 102 in the present invention may also functionally be separated into a charge generation layer and a charge transport layer (both not shown) which are constituted of an amorphous material containing at least silicon atoms to provide a function-separated photosensitive member. In such an electrophotographic photosensitive member, photocarriers are formed chiefly in the charge generation layer upon irradiation by light and pass through the charge transport layer to reach the conductive substrate 101.

The conductive substrate 101 may have any desired shape according to the drive method of the electrophotographic photosensitive member.

(1) Conductive Substrate

The conductive substrate 101 in the present invention may include insulating substrates made of materials such as aluminum, iron, chromium, magnesium, stainless steel and alloys of any of these, as well as glass, quartz, ceramics and heat-resistant synthetic resin films the surfaces of which have been conductive-treated at least on their side on which the photoconductive layer is to be formed. It is also preferable for these surfaces to be subjected to mirror-finishing by means of a lathe. The conductive substrate may have any shape including the shape of a roller and the shape of an endless belt.

(2) Surface Layer

The surface layer 103 in the present invention comprises a non-single-crystal carbon film containing at least hydrogen. The "non-single-crystal carbon" herein referred to is chiefly meant to be amorphous carbon having properties intermediate between graphite and diamond, and may be microcrystalline or polycrystalline in part. This surface layer 103 has a free surface, and is provided chiefly for the purpose of achieving the object of the present invention, i.e., for preventing wear and scratching in its use over a long period of time.

The surface layer 103 in the present invention may preferably have, as described previously, a dynamic hardness in the range of from $4.90\times10^9$ to $1.76\times10^{10}$ Pa (500 to 1,800 kgf/mm$^2$). In the sense that a sufficient latitude should be taken against wear resistance and film peeling, the surface layer may more preferably have a dynamic hardness in the range of from $6.86\times10^9$ to $1.47\times10^{10}$ Pa (700 to 1,500 kgf/mm$^2$).

In the present invention, the dynamic hardness of the surface layer is measured in the following way. To the surface of a surface layer sample deposited on a silicon wafer, a load is vertically applied using a conical diamond stylus having a tip of 0.1 $\mu$m or smaller in radius and having a dihedral angle of 115°, where the relationship between the load and the depth of indentation is applied to an equation $DH=\alpha\times p/d^2$ to calculate dynamic hardness DH. Here, $\alpha$ is 3.8584, p is the load (mN) and d is the depth of indentation ($\mu$m). The depth of indentation is set about ⅕ or smaller of the layer thickness of the a-C:H film in order to prevent any influence of the underlying layer. Stated specifically, a photosensitive member piece of 3 cm×3 cm is cut out, and the dynamic hardness is measured with a dynamic hardness meter DUH-201S, manufactured by Shimadzu Corporation.

The surface layer comprising an a-C:H film according to the present invention can be formed by usual plasma-assisted CVD (chemical vapor deposition) as an example. The plasma-assisted CVD commonly has a great system dependence, and hence the conditions for film formation under which the surface layer 103 according to the present invention is obtainable can not sweepingly be prescribed.

In general, the characteristics of deposited films to be formed may greatly change depending on the types of material gases, the types of carrier gases, the methods of mixing the gases, the method of feeding the gases, the regulation of evacuation form, the regulation of pressure, the regulation of electric power, the regulation of frequency, the regulation of electric-power wave form, the regulation of direct-current bias, the regulation of conductive-substrate temperature, the regulation of film formation time and so forth. Accordingly, in the controlling of the indentation hardness in the dynamic hardness test, too, which is according to the present invention, those parameters may appropriately be regulated, whereby conditions therefor can be set with ease in any film-forming systems. In particular, it is effective to regulate the electric power and the direct-current bias when the dynamic hardness is controlled. The surface layer 103 in the present invention can be formed by plasma-assisted CVD, sputtering, ion plating or the like in which hydrocarbons which are gaseous at normal temperature and normal pressure are used as material gases. Films formed by a plasma-assisted CVD process described later are preferable for their use as surface layers because they are high in both transparency and hardness. Also, as discharge frequency used in plasma-assisted CVD when the surface layer 103 according to the present invention is formed, any frequency may be used. Preferably, a frequency of 1 to 450

MHz may be used. In an industrial scale, preferably usable are a high frequency of from 1 MHz or higher to lower than 450 MHz, and typically 13.56 MHz, called an RF frequency band, and a high frequency of from 50 MHz or higher to 450 MHz or lower, and typically 105 MHz, called a VHF frequency band.

Materials that can serve as material gases for feeding carbon may include gaseous or gasifiable hydrocarbons such as $CH_4$, $C_2H_6$, $C_3H_8$ and $C_4H_{10}$. In view of readiness in handling for layer formation and carbon-feeding efficiency, the material may preferably include $CH_4$ and $C_2H_6$. Also, these carbon-feeding material gases may be used optionally after their dilution with a gas such as $H_2$, He, Ar or Ne.

The surface layer 103 comprised of a-C:H in the present invention can attain the like effect even when some impurities are contained. For example, even when impurities such as Si, N, O, P and/or B are contained in the surface layer 103, the effect of the present invention can be attained as long as they are in a content not more than 10% based on that of the total elements.

The surface layer 103 according to the present invention is incorporated with hydrogen atoms. The incorporation of hydrogen atoms effectively compensates any structural defects present in the film to reduce its localized-state level density. Hence, the film is improved in transparency, and the surface layer can be kept therein from any unwanted unnecessary absorption of light, bringing about an improvement in photosensitivity. Also, the presence of hydrogen atoms in the film is said to play an important role for solid lubricity.

The hydrogen atoms incorporated in the the surface layer 103 film comprised of a-C:H may preferably be in a content of from 41 to 60 atomic %, and more preferably from 45 to 50 atomic %. If the hydrogen content is less than 41 atomic %, the surface layer may have a narrow optical band gap to become unsuitable in view of sensitivity. If on the other hand it is more than 60 atomic %, the surface layer may have a low hardness to tend to cause abrasion.

In the present invention, as a method of measuring the content of hydrogen atoms incorporated in the surface layer of the photosensitive member, it may include the following method.

On a silicon wafer mirror-polished when the surface layer is formed, a film is deposited in a thickness of 1 $\mu$m under the same production conditions as those at the time of film formation to prepare a sample. Infrared absorption spectra of this sample are measured with an infrared spectrophotometer. In the case when the hydrogen content is measured, the hydrogen content in the film can be determined from the area of C-Hn absorption peak appearing at 2,920 $cm^{-1}$ vicinity and the layer thickness.

The amount of hydrogen atoms incorporated in the surface layer may be controlled by controlling, e.g., the temperature of conductive substrate when the photosensitive member is produced, the amount of feed materials used to incorporate hydrogen atoms which are fed into a reactor, and the discharging electric power. Optical band gaps of the surface layer may commonly be at a value of from 1.2 to 2.2 eV, which may be preferable, and may more preferably be 1.6 eV or more in view of sensitivity.

The surface layer 103 may preferably have a refractive index of from 1.6 to 2.8.

The surface layer may have a layer thickness of from 5 to 1,000 nm, and preferably from 10 to 200 nm. If it has a thickness smaller than 5 nm, its mechanical strength may come into question. If it has a thickness larger than 1,000 nm, a problem tends to occur in respect of photosensitivity. The layer thickness of the surface layer can be measured with an interference layer thickness meter. Whether or not the surface layer has been formed in the desired layer thickness can be confirmed by such measurement.

Halogen atoms may optionally be incorporated in the surface layer 103 in the present invention. Materials that can serve as material gases for feeding halogen atoms may include, e.g., $F_2$ and interhalogen compounds such as BrF, ClF, $ClF_3$, $BrF_3$, $BrF_5$, $IF_3$ and $IF_7$. Fluorine-containing gases such as $CF_4$, $CHF_3$, $C_2F_6$, $ClF_3$, $CHClF_2$, $C_3F_8$ and $C_4F_{10}$ may further preferably be used.

In the present invention, atoms capable of controlling the conductivity may further optionally be incorporated in the surface layer 103. The atoms capable of controlling the conductivity may include what is called impurities, used in the field of semiconductors. Usable are atoms belonging to Group 3B of the periodic table, capable of imparting p-type conductivity, or atoms belonging to Group 5B of the periodic table, capable of imparting n-type conductivity. The atoms capable of controlling the conductivity, incorporated in the surf ace layer 103 in the present invention, may preferably be in an amount of from 10 to $1\times10^4$ atomic ppm, more preferably from 50 to $5\times10^3$ atomic ppm, and most preferably from $1\times10^2$ to $1\times10^3$ atomic ppm.

The conductive substrate temperature set when the surface layer is deposited may be regulated to from room temperature to 400° C. Any too high substrate temperature may lower band gaps to lower transparency, and hence the temperature may preferably be set on the lower side.

With regard to high-frequency power, it may preferably be as high as possible because the decomposition of material gases proceeds sufficiently. Stated specifically, it may preferably be 5 W or higher per 1 ml/min (normal) of materials gas. Any too high power may cause abnormal discharge to cause deterioration of characteristics of the electrophotographic photosensitive member, and hence it must be controlled to a power suitable enough not to cause the abnormal discharge. With regard to the pressure of discharge space, it may be kept at 13.3 to 1,330 Pa when a usual RF power (typically 13.56 MHz) is used, and at 13.3 mPa to 1,330 Pa when a VHF power (typically 50 to 450 MHz) is used. It may preferably be a pressure as low as possible.

(2) Photoconductive Layer

The photoconductive layer 102 of the photosensitive member in the present invention comprises a non-single-crystal material composed chiefly of silicon, containing hydrogen and/or a halogen.

The "non-single-crystal material composed chiefly of silicon" herein referred to is chiefly meant to be amorphous silicon, and may be microcrystalline or polycrystalline in part.

The photoconductive layer 102 in the present invention may preferably be any non-single-crystal material composed chiefly of silicon, i.e., what is called an a-Si film.

The a-Si film can be formed by plasma-assisted CVD, sputtering or ion plating. The film formed by plasma-assisted CVD is preferred because a film having an especially high quality can thereby be obtained. As an excitation source for the plasma-assisted CVD, glow discharge plasma produced by high-frequency power, VHF-power or microwaves having any frequency may preferably be used. A material gas containing silicon atoms is decomposed by this glow discharge plasma to form the film.

As the material gas, a gaseous or gasifiable silicon hydride (silane) such as $SiH_4$, $Si_2H_6$, $Si_3H_8$ or $Si_4H_{10}$ may be used, which may be decomposed using a high-frequency power to form the film.

When the photoconductive layer is deposited, the conductive substrate may preferably be kept at a temperature of about 150 to 450° C. in view of the film characteristics. This is to accelerate surface reaction on the substrate surface to relax its structure sufficiently. Also, the above gas may further be mixed with $H_2$ or a halogen-containing gas in a desired quantity to form the layer. This is preferable in order to improve the characteristics.

Materials that can be effective as material gases for feeding halogen atoms may include fluorine gas ($F_2$) and interhalogen compounds such as BrF, ClF, $ClF_3$, $BrF_3$, $BrF_5$, $IF_3$ and $IF_7$.

A silicon compound containing a halogen atom, as exemplified by a silane derivative substituted with a halogen atom may also be used as the material. Such a silane derivative may include silicon fluorides such as $SiF_4$ and $Si_2F_6$ as preferred examples. Also, these halogen-feeding material gases may be used optionally after their dilution with a gas such as $H_2$, He, Ar or Ne.

There are no particular limitations on the layer thickness of the photoconductive layer. It may appropriately be determined in the range of from 1 to 100 $\mu$m in accordance with the chargeability and sensitivity required by the image-forming apparatus itself. In usual cases, it may preferably be 10 $\mu$m or more in view of chargeability and sensitivity, and 50 $\mu$m or less from the viewpoint of industrial productivity.

The photoconductive layer may also be formed in multilayer construction in order to improve characteristics. For example, a layer having narrower band gaps may be disposed on the surface side, and a layer having broader band gaps on the substrate side. This enables simultaneous improvement of photosensitivity and charging performance. In particular, the designing of such layer construction can bring out a striking effect on light sources having a relatively long wavelength and also little scattering of wavelength as in semiconductor lasers.

As discharge frequency used in plasma-assisted CVD when the photoconductive layer in the present invention is formed, any frequency may be used. In an industrial scale. preferably usable are a high frequency of from 1 MHz or higher to lower than 50 MHz, called an RF frequency band, and a high frequency of from 50 MHz or higher to 450 MHz or lower, called a VHF frequency band.

The photoconductive layer described above may also be so constructed as to be functionally separated into two layers, a charge generation layer and a charge transport layer, as described previously.

(3) Buffer Layer

The electrophotographic photosensitive member in the present invention may also have a form in which a buffer layer is provided between the surface layer 103 and the photoconductive layer 102.

The buffer layer 105 comprises a non-single-crystal material which is basically formed of amorphous silicon composed chiefly of silicon atoms, containing hydrogen and/or a halogen, [a-Si(H,X)] and which further contains at least one kind of atoms selected from carbon atoms, nitrogen atoms and oxygen atoms. Such a non-single-crystal material may include amorphous silicon carbide, amorphous silicon nitride and amorphous silicon oxide. It may more preferably be formed of an amorphous silicon carbide having composition intermediate between a-Si and a-C:H, (a-Si:C(H,X)). In this case, the composition of the buffer layer may continuously be changed from the photoconductive layer side toward the surface layer 103 side. This is effective for preventing interference or the like. Also, in the buffer layer 105, dopants such as Group 3B elements or Group 5B elements may be incorporated so that its conductivity type can be controlled and the layer can be made to have an upper-part blocking ability to block the injection of charged carriers from the surface.

Material gases used for the buffer layer in the present invention may preferably include the following.

Materials that can serve as material gases for feeding carbon may include gaseous or gasifiable hydrocarbons such as $CH_4$, $C_2H_6$, $C_3H_8$ and $C_4H_{10}$.

Materials that can serve as material gases for feeding nitrogen or oxygen may include gaseous or gasifiable compounds such as $NH_3$, NO, $N_2O$, $NO_2$, $O_2$, CO, $CO_2$ and $N_2$.

The buffer layer can be formed by plasma-assisted CVD, sputtering or ion plating. Also, as discharge frequency used in plasma-assisted CVD when the buffer layer in the present invention is formed, any frequency may be used. In an industrial scale, preferably usable are a high frequency of from 1 MHz or higher to lower than 50 MHz, called an RF frequency band, and a high frequency of from 50 MHz or higher to 450 MHz or lower, called a VHF frequency band.

When the buffer layer is deposited, the conductive substrate may preferably be regulated to a temperature of from 50 to 450° C., and more preferably from 100 to 300° C.

(4) Other Layer

In addition to the surface layer, buffer layer and photoconductive layer described above, the photosensitive member of the present invention may also preferably be provided with a lower-part blocking layer 104 between the photoconductive layer and the conductive substrate.

In the case when the lower-part blocking layer 104 is provided, it may commonly be formed of a-Si(H,X) as a base, and may be incorporated with dopants such as Group 3B elements or Group 5B elements so that its conductivity type can be controlled and the layer can be made to have the ability to block the injection of carriers from the conductive substrate. In this case, at least one kind of atoms selected from carbon atoms, nitrogen atoms and oxygen atoms may optionally be incorporated to regulate stress, and to make the layer have the function to improve adherence to the photoconductive layer.

[2] Production of Electrophotographic Photosensitive Member in the Present Invention An example for the production of the electrophotographic photosensitive member in the present invention is described below.

Figure 2:
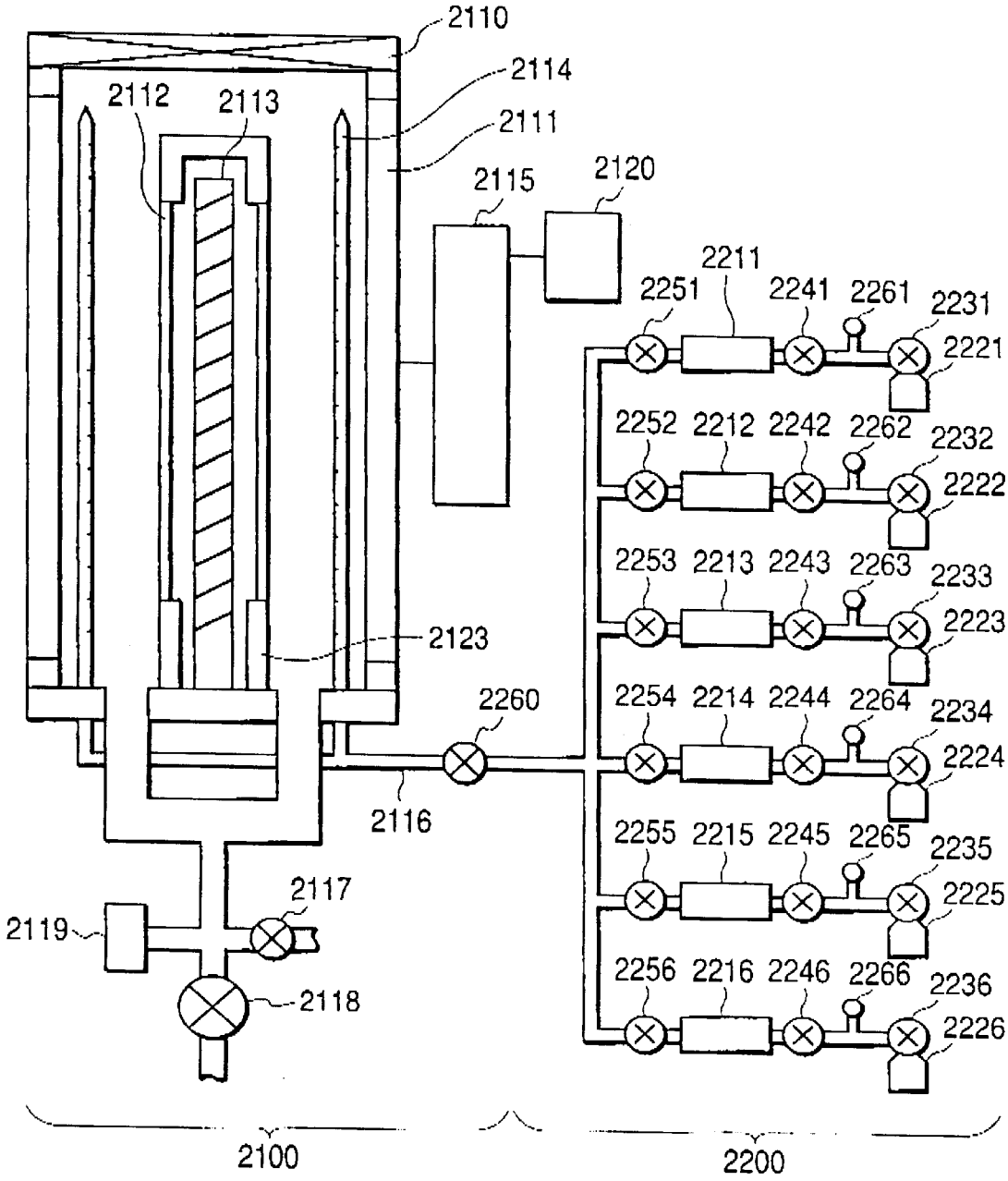
FIG. 2 is a schematic illustration of an example of a deposition system for forming an electrophotographic photosensitive member.

FIG. 2 diagrammatically illustrates an example of a deposition apparatus for producing the photosensitive member by RF plasma-assisted CVD making use of a high-frequency power source.

Stated roughly, this apparatus is chiefly constituted of a deposition system 2100, a material gas feed system 2200 and an exhaust system (not shown) for evacuating the inside of a film-forming reactor 2110.

In the film-forming reactor 2110 in the deposition system 2100, a conductive substrate 2112 as grounded, a hoater 2113 for heating the conductive substrate, and a material gas feed pipe 2114 are provided. A high-frequency power 2120 is also connected to the film-forming reactor through a high-frequency matching box 2115.

The material gas feed system 2200 is constituted of gas cylinders 2221 to 2226 for material gases such as $SiH_4$, $H_2$, $CH_4$, NO, $B_2H_6$ and $CF_4$, valves 2231 to 2236, 2241 to 2246 and 2251 to 2256, and mass flow controllers 2211 to 2216. The gas cylinders for the respective material gases are connected to a gas feed pipe 2114 in the film-forming reactor 2110 through a valve 2260.

The conductive substrate 2112 is set on a conductive holding stand 2123, and thus connected to a ground.

An example of procedure of a method for forming photosensitive-member deposited films by means of the system shown in FIG. 2 is described below.

The conductive substrate 2112 is set in the film-forming reactor 2110, and the inside of the film-forming reactor 2110 is evacuated by means of an evacuation unit (e.g., a vacuum pump) (not shown). Subsequently, the temperature of the conductive substrate 2112 is controlled at a desired temperature of from 150 to 450° C. by means of the heater 2113 for heating the conductive substrate. Then, before material gases for forming photosensitive-member deposited films are flowed into the film-forming reactor 2110, gas cylinder valves 2231 to 2236 and a leak valve 2117 of the film-forming reactor are checked to make sure that they are closed, and also flow-in valves 2241 to 2246, flow-out valves 2251 to 2256 and an auxiliary valve 2260 are checked to make sure that they are opened. Then, firstly a main valve 2118 is opened to evacuate the insides of the film-forming reactor 2110 and a gas feed pipe 2116.

Thereafter, at the time a vacuum gauge 2119 has been read to indicate a pressure of 0.67 mPa, the auxiliary valve 2260 and the flow-out valves 2251 to 2256 are closed. Thereafter, valves 2231 to 2236 are opened so that gases are respectively introduced from gas cylinders 2221 to 2226, and each gas is controlled to have a pressure of 0.2 MPa by operating pressure controllers 2261 to 2266. Next, the flow-in valves 2241 to 2246 are slowly opened so that gases are respectively introduced into mass flow controllers 2211 to 2216.

After the film formation is thus ready to start, the photoconductive layer is first formed according to the following procedure.

That is, at the time the conductive substrate 2112 has had the desired temperature, some necessary flow-out valves 2251 to 2256 and the auxiliary valve 2260 are slowly opened so that desired gases are fed into the film-forming reactor 2110 from the gas cylinders 2221 to 2226 through a gas feed pipe 2114. Next, the mass flow controllers 2211 to 2216 are operated so that each material gas is regulated to flow at a desired rate. In that course, the opening of the main valve 2118 is so adjusted that the pressure inside the film-forming reactor 2110 comes to be a desired pressure of 13.3 Pa to 1,330 Pa, watching the vacuum gauge 2119. At the time the inner pressure has become stable, the high-frequency power source 2120 is set at the desired electric power, for example, a high-frequency of from 1 to 50 MHz, e.g., 13.56 MHz, and the high-frequency power is supplied to a cathode electrode 2111 through the high-frequency matching box 2115 to cause glow discharge to take place.

The material gases fed into the film-forming reactor 2110 are decomposed by the discharge energy thus produced, so that the desired photoconductive layer composed chiefly of silicon atoms is formed on the conductive substrate 2112. After the layer with a desired thickness has been formed, the supply of high-frequency power is stopped, and the flow-out valves 2251 to 2256 are closed to stop the material gases from flowing into the film-forming reactor 2110. The formation of the photoconductive layer is thus completed. The photoconductive layer may be formed in known composition and layer thickness.

Next, the surface layer is film-formed. The surface layer may be formed according to basically the same procedure for film-forming the photoconductive layer, except that a hydrocarbon gas such as $CH_4$ or $C_2H_6$ is used as the material gas and a dilute gas such as $H_2$ is optionally used. In the film formation of the surface layer, the high-frequency power source 2120 is set at a frequency of, e.g., from 1 to 50 MHz, and typically 13.56 MHz, and the high-frequency power is supplied to the cathode electrode 2111 through the high-frequency matching box 2115 to cause glow discharge to take place. Also, in order to achieve uniform formation of the layer in the course of the layer formation, the conductive substrate 2112 and the conductive holding stand 2123 may optionally be rotated at a desired speed by means of a drive unit (not shown).

Thus, the photosensitive member in the present invention is produced.

Figure 3:
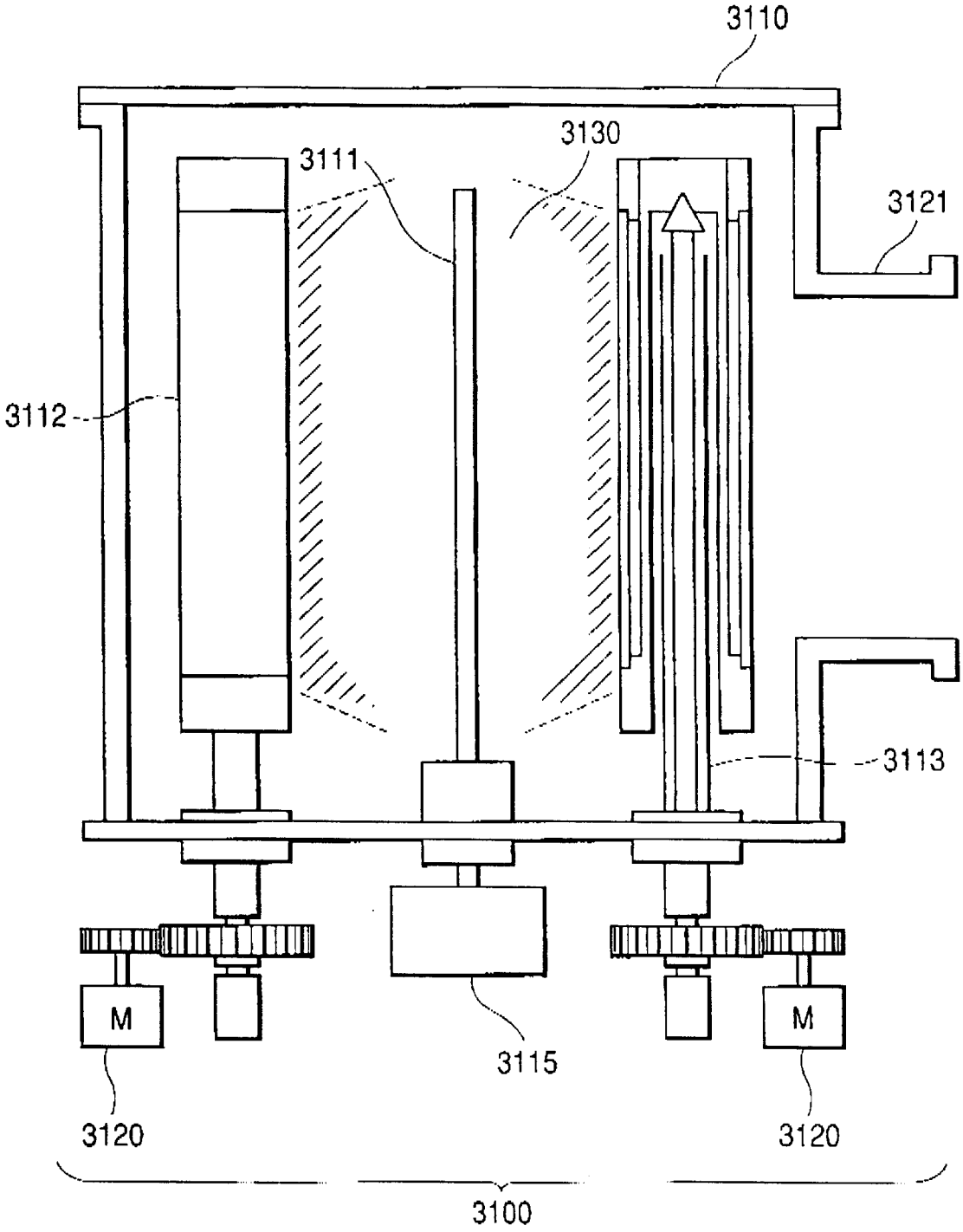
FIG. 3 is a schematic illustration of an example of a deposition system for forming electrophotographic photosensitive members.

FIG. 3 diagrammatically illustrates an example of a deposition apparatus for producing the photosensitive member by VHF plasma-assisted CVD method making use of a VHF power source.

This apparatus is set up by replacing the deposition system 2100 shown in FIG. 2, with a deposition system 3100 shown in FIG. 3.

The formation of deposited films by VHF plasma-assisted CVD method using this apparatus may be carried out basically in the same manner as the case of RF plasma-assisted CVD method, provided that the high-frequency power to be applied is supplied from a VHF power source of 50 to 450 MHz, e.g., 105 MHz, in frequency, and the pressure is set at about 13.3 mPa to 13.3 Pa, which is a little lower than that in the RF plasma-assisted CVD method. First, conductive substrates 3112 are set inside a reactor 3110. Then, the inside of the reactor 3110 is evacuated by means of an evacuation unit not shown (e.g., a diffusion pump) through an exhaust pipe 3121. Subsequently, the conductive substrates 3112 are heated by heaters 3113 for heating the conductive substrates. Then, material gases are fed into the reactor through gas feed pipes (not shown). In a discharge space 3130 surrounded by the conductive substrates 3112, the material gases fed into the reactor are excited and dissociated by glow discharge made to take place by supplying a VHF power to the discharge space 3130 through a matching box 3115, thus the intended deposited films are formed on the conductive substrates 3112. Here, in order to achieve uniform formation of the layers, the conductive substrates 3112 may preferably be rotated at a desired rotational speed by means of motors 3120 for rotating the substrates.

[3] Charging Means in the Present Invention

The charging means in the present invention may be any charging assembly as long as it performs contact charging. Preferably, it may be a contact charging unit having a magnetic-brush charging member whose magnetic-brush is formed by binding magnetic particles magnetically to its support member.

Figure 4:
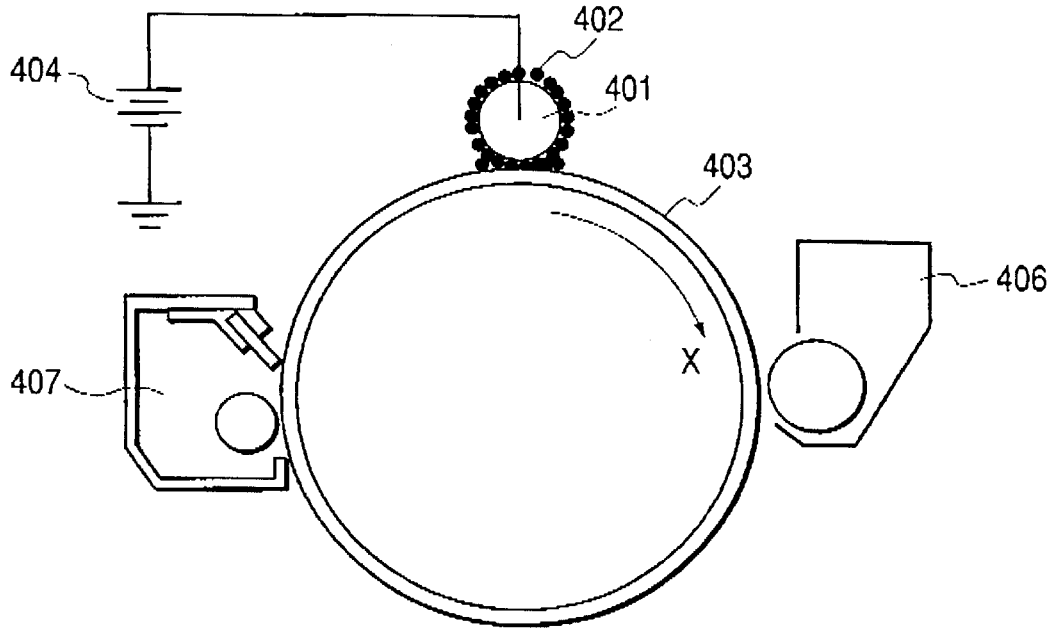
FIG. 4 is a schematic illustration of an example of a contact charging unit used in the image-forming apparatus of the present invention.

FIG. 4 illustrates an example of an image-forming apparatus in which such a magnetic-brush charging member is used as the contact charging unit. The magnetic-brush charging member comprises a mandrel (the support member) 401 made of a magnetic body, and formed on its periphery a magnetic-brush layer 402 constituted of magnetic particles. The mandrel 401 is connected with a voltage application means 404, and the magnetic-brush layer 402 is kept in contact with the surface of the electrophotographic photosensitive member to perform charging. Reference numeral 406 denotes a developing assembly; and 407, a cleaner.

As the mandrel 401, a ferrite magnet or a magnetic body capable of providing multi-polar construction of a plastic magnet may be used.

To the mandrel 401, the voltage application means 404 is connected, and a direct-current voltage (Vdc) or a voltage formed by superimposing an alternating-current voltage to a direct-current voltage (Vdc+Vac) is applied to the magnetic particles of the magnetic brush 402 via the mandrel 401. Thus, electric charges are directly injected through the part of contact with the surface of the photosensitive member 403, and the photosensitive member is uniformly charged.

The magnetic-brush charging member is rotated and moved at an appropriate relative speed with respect to the rotational direction x of the photosensitive member 403. It may also be kept vibrated.

The magnetic particles may preferably have a volume-average particle diameter of from 10 to 50 μm, and more preferably from 15 to 30 μm. If the particles are smaller than 10 μm, the magnetic brush tends to adhere to the photosensitive member, and also the magnetic particles may have a poor transport performance when made into the magnetic brush. If the particles are larger than 50 μm, the magnetic particles and the photosensitive member may have less contact points to tend to deteriorate the charging uniformity of injection charging.

In the present invention, the volume-average particle diameter and particle size distribution of the magnetic particles are measured using a laser diffraction particle size distribution measuring instrument HELOS (manufactured by Nippon Denshi K.K.) and a dry dispersion unit RODOS (manufactured by Nippon Denshi K.K.) in combination, under conditions of a lens focal length of 200 mm, a dispersion pressure of 3.0 Bar and a measurement time of 1 to 2 seconds, dividing the range of particle diameters of 0.5 μm to 350 μm into 31 channels. The 50% particle diameter (median diameter) of volume distribution is determined as volume-average particle diameter and also the percent (%) by volume of particles in each particle diameter range can be determined from volume-based frequency distribution. In the present invention, the laser diffraction particle size distribution measuring instrument HELOS is an instrument which makes measurement by the principle of Fraunhofer diffraction. To explain this measurement principle, a laser beam is applied to measuring particles from a laser beam source, whereupon a diffraction image is formed on the focal plain of a lens placed on the opposite side of the laser beam source. This diffraction image is detected with a detector, followed by arithmetic processing to calculate the particle size distribution of the measuring particles.

The magnetic particles used in the present invention may preferably have a volume resistivity of from $1\times10^4$ to $1\times10^9\Omega\cdot$cm. If the volume resistivity is lower than $1\times10^4\Omega\cdot$cm, pinhole leak tends to occur. If is is higher than $1\times10^9\Omega\cdot$cm, the photosensitive member tends to be insufficiently charged. In the sense of magnetic-particle leakage, the magnetic particles for charging may more preferably have a volume resistivity of $1\times10^5\Omega\cdot$cm or higher.

In the present invention, the volume resistivity of the magnetic particles is measured in the following way. An insulating cell is filled with magnetic particles, and opposing electrodes are provided in contact with the magnetic particles, where a voltage is applied cross the electrodes, and the electric current flowing there is measured. Measuring conditions are as follows: In an environment of 23° C./65% RH, the magnetic particles and the electrodes are kept in contact in a contact area of 2 $cm^2$ and in a thickness of 1 mm, under application of a load of 10 kg to the upper electrode and at an applied voltage of 100 V. Further, as resistance distribution preferable in the present invention, the magnetic particles may have a small difference in resistivity between particles having a relatively small particle diameter and particles having a relatively large particle diameter.

As the magnetic particles in the present invention, various materials of single or mixed crystals of conductive metals such as ferrite and magnetite may be used. Besides, the magnetic particles may be particles comprised of fine particles having conductivity and magnetic properties and dispersed in a binder resin, as obtained by kneading the fine particles having conductivity and magnetic properties, together with the binder resin described later and by shaping the kneaded product into particles. Also, the magnetic particles may be made to have such construction that such conductive magnetic particles are further coated with a resin. In such construction, ferrite particles may preferably be used. As the composition of ferrite, those containing a metallic element such as copper, zinc, manganese, magnesium, iron, lithium, strontium or barium may preferably be used.

The binder resin to be used in the interiors of the magnetic particles may include homopolymers or copolymers of styrenes such as styrene and chlorostyrene; monoolefins such as ethylene, propylene, butylene and isobutylene; vinyl esters such as vinyl acetate, vinyl propionate, vinyl benzoate and vinyl lactate; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone. In particular, in view of dispersibility of conductive fine particles and productivity, preferred are polystyrene, a styrene-alkyl acrylate copolymer, a styrene-acrylonitrile copolymer, a styrene-butadiene copolymer, a styrene-maleic anhydride copolymer, polyethylene and polypropylene. Also preferred are polycarbonate, phenol resins, polyesters, polyurethanes, epoxy resins, polyolefins, fluorine resins, silicone resins and polyamides.

Here, the fluorine resins may include, e.g., solvent-soluble copolymers obtained by polymerization of polyvinyl fluoride, polyvinylidene fluoride, polytrifluoroethylene, polychlorotrifluoroethylene, polydichlorodifluoroethylene, polytetrafluoroethylene or polyhexafluoropropylene with other monomers.

The magnetic particles may preferably have a saturation magnetization of from 15 to 70 $Am^2/kg$. If the magnetic particles have a saturation magnetization higher than 70 $Am^2/kg$, they may provide so large a magnetic binding force as to make the ears of the magnetic brush too hard to move freely, tending to cause faulty charging because of a lowering of their performance of contact with the photosensitive member or wear the photosensitive member (drum) because of the hard ears of the magnetic brush. If the magnetic particles have a saturation magnetization lower than 15 $Am^2/kg$, they may provide so small a magnetic binding force as not to return to the magnetic brush after they have moved to the photosensitive member (drum), so that, because of a decrease of particles, the charging may deteriorate and the stops of development, transfer and fixing may adversely be affected.

In the present invention, the saturation magnetization is measured with a vibration magnetic force meter VSM-3S-15 (manufactured by Toei Kogyo) under application of a magnetic field of 79.6 kA/m (1 k oersteds), and the amount of its magnetization is regarded as the saturation magnetization.

The magnetic particles in the present invention may preferably be in such a form that the particles have surface layers for the purpose of regulating the resistance and controlling the polarity of triboelectric charging to toner.

The form of such surface layers is to cover the surfaces of magnetic particles with vacuum deposited films, resin films, conductive resin films or resin films having a conducting agent dispersed therein, or to coat the surfaces with a coupling agent or the like.

The surface layers need not necessarily cover or coat the magnetic particles completely, and the magnetic particles may stand partly uncovered as long as the effect of the present invention can be obtained. Namely, the surface layers may be formed in a discontinuous form.

For the resin film as the surface layer of the magnetic particles, a binder resin is used. The binder resin may include, like those for the interiors of the magnetic particles, homopolymers or copolymers of styrenes such as styrene and chlorostyrene; monoolefins such as ethylene, propylene, butylene and isobutylene; vinyl esters such as vinyl acetate, vinyl propionate, vinyl benzoate and vinyl lactate; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone. In particular, in view of film forming properties as coat layers and productivity, preferred are polystyrene, a styrene-alkyl acrylate copolymer, a styrene-acrylonitrile copolymer, a styrene-butadiene copolymer, a styrene-maleic anhydride copolymer, polyethylene and polypropylene. Also preferred are polycarbonate, phenol resins, polyesters, polyurethanes, epoxy resins, polyolefins, fluorine resins, silicone resins and polyamides.

Here, the fluorine resins may include, e.g., solvent-soluble copolymers obtained by polymerization of polyvinyl fluoride, polyvinylidene fluoride, polytrifluoroethylene, polychlorotrifluoroethylene, polydichlorodifluoroethylene, polytetrafluoroethylene or polyhexafluoropropylene with other monomers.

The resin films having a conducting agent dispersed therein may be obtained by dispersing a conducting agent in the above binder resin. The conducting agent may include metals such as copper, nickel, iron, aluminum, gold and silver, metal oxides such as iron oxide, ferrite, zinc oxide, tin oxide, antimony oxide and titanium oxide, and also electron-conductive conducting powders such as carbon black. It may further include, as ionic conducting agents, lithium perchlorate and quaternary ammonium salts.

The coupling agent may include titanate type coupling agents such as isopropoxytriisostearoyl titanate, dihydroxybis(lactato)titanium and diisopropoxybis (acetylacetonato)titanium; aluminum type coupling agents such as acetoalkoxyaluminum diisopropylate; and silane type coupling agents such as dimethylaminopropyltrimethoxysilane, n-octadecyldimethylmethoxysilane, n-hexyltriethoxysilane, 3-aminopropyltrimethoxysilane and n-octadecyltrimethoxysilane. A functional group such as an amino group or fluorine may also appropriately be introduced into it. In the case of the coupling agent, very thin coating films (at a molecular level) are formed on the magnetic particle surfaces, and hence may have less influence on the resistance value of the magnetic particles. Accordingly, any treatment for resistance regulation need not be made on the coat layers as long as the resistance of cores which are the magnetic particles is regulated.

The charging means in the present invention may also be a contact charging unit having a conductive fine powder interposed at the part of contact (contact zone) between the photosensitive member and the charging member.

Figure 5:
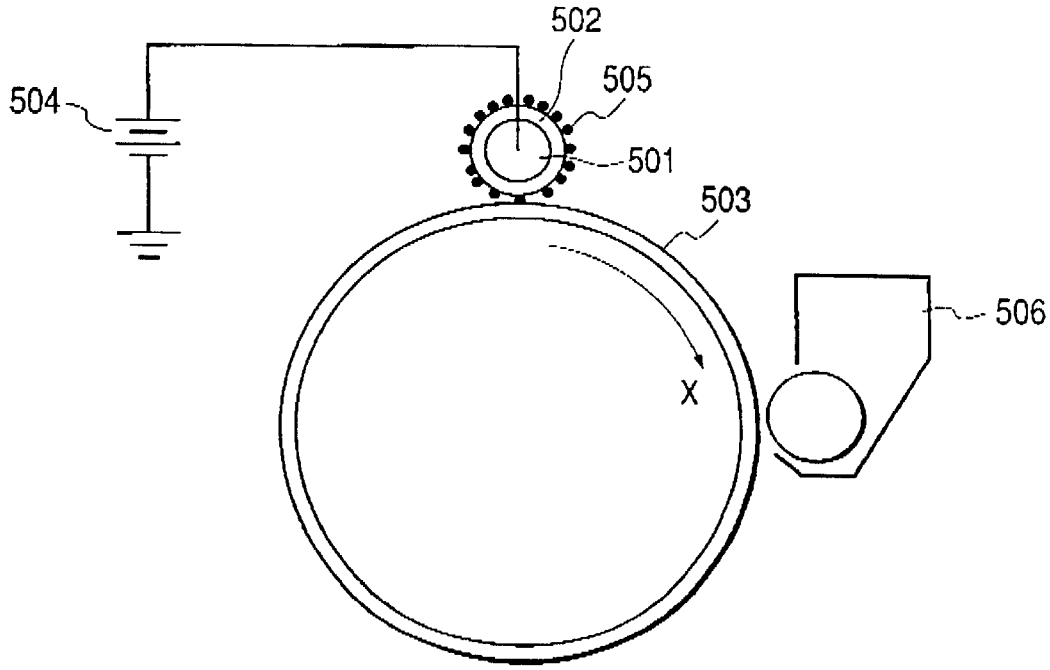
FIG. 5 is a schematic illustration of another example of a contact charging unit used in the image-forming apparatus of the present invention.

FIG. 5 illustrates an example of an image-forming apparatus in which an elastic roller having the conductive fine powder interposed at that contact zone is used as a charging member of the contact charging unit.

FIG. 5 shows a contact charging unit having a charging member comprising a mandrel 501 formed of a conductive material, and provided thereon an elastic layer 502 which is formed of an elastic material having a porous-material surface, such as a sponge, and a conductive fine powder 505 made to adhere to its surface. The conductive fine powder 505 interposed between the elastic layer 502 of the charging member and a photosensitive member 503 more improves the state of contact, and affords a charging method improved in the injection of electric charges by charging. Reference numeral 504 denotes a voltage application means; and 506, a developing assembly.

To interpose the conductive fine powder at the contact zone, a method is available in which, as will be detailed later, the charging means is provided with a conductive-fine-powder feed means for feeding the conductive fine powder to the charging member surface, or the conductive fine powder is externally added to the toner so as to be indirectly interposed at the contact zone.

The charging member in the present invention may also preferably be a roller member having an Asker-C hardness of 50 degrees or lower. Any too low hardness may make the roller member have so unstable a shape as to come into poor contact with the charging object member (photosensitive member). Also, the conductive fine powder interposed at the part of contact between the roller member and the photosensitive member may abrade or scratch the roller member surface, so that no stable charging performance may be attained. On the other hand, any too high hardness not only may make it impossible to ensure the charging contact zone between the roller member and the charging object member, but also may make poor the former's accurate contact with the surface of the latter. Accordingly, the roller member may have an Asker-C hardness of 25 degrees or higher to 50 degrees or lower as a preferable range.

It is important for the roller member to have an elasticity to attain a sufficient state of contact with the charging object member and at the same time to function as an electrode having a resistance low enough to charge the moving charging object member. On the other hand, it is necessary to prevent voltage from leaking when any defective portions such as pinholes are present in the charging object member. In the case when the electrophotographic photosensitive member is used as the charging object member, the roller member may have a volume resistivity of from $1\times10^3$ to $1\times10^8$ Ω·cm in order to achieve sufficient charging performance and anti-leak.

To measure the volume resistivity of the roller member, a roller is kept in pressure contact with a cylindrical aluminum drum of 30 mm in diameter in such a way that a load of 1 kg in total pressure is applied to the mandrel of the roller, in the state of which a voltage of 100 V is applied across the mandrel and the aluminum drum to make measurement.

The roller member in the present invention can be produced by, e.g., forming on a mandrel a medium-resistance layer of a rubber or foam as a flexible member. The medium-resistance layer may be comprised of a resin (e.g., urethane), conductive particles (e.g., carbon black), a curing agent, a blowing agent and so forth, and is formed on the mandrel to provide the form of a roller. Thereafter, the roller formed may optionally be cut, and its surface may be ground to be shaped as desired, thus the roller member can be produced. A voltage application means 504 is connected to the mandrel 501, and a direct-current voltage (Vdc) is applied to the charging member via the mandrel 501, where electric charges are directly injected through the conductive fine powder 505 interposed at the part of contact between the charging member and the surface of the photosensitive member. Thus, the photosensitive member surface is uniformly charged.

The elastic-roller charging member is rotated and moved at an appropriate relative speed with respect to the rotational direction x of the photosensitive member 503. It may also be kept vibrated.

A difference in relative speed may be provided between the movement speed of the surface of the charging member and the movement speed of the surface of the photosensitive member. This can remarkably add the opportunities of contact of the conductive fine powder with the photosensitive member at the part of contact between the contact charging member and the photosensitive member to achieve a higher contact performance. This is preferable in view of the improvement of direct-injection charging performance.

The conductive fine powder interposed at the part of contact between the contact charging member and the photosensitive member makes it possible to provide the difference in speed without causing any great increase in torque between the contact charging member and the photosensitive member and any remarkable abrasion of the contact charging member and photosensitive member surfaces, because of a lubricating effect (friction reduction effect) attributable to the conductive fine powder.

In order that any transfer residual toner left on the photosensitive member and carried to the charging zone is temporarily collected in the contact charging member and is leveled there, the contact charging member and the photosensitive member may preferably be moved in the direction opposite to each other at their contact zone. For example, the contact charging member may preferably be so constructed that it is rotatingly driven and, in addition, as its rotational direction it is rotated in the direction opposite to the direction of movement of the photosensitive member surface at the contact zone between them. That is, the charging is performed in the state the transfer residual toner left on the photosensitive member is once drawn apart by the rotation in the opposite direction, and hence the charging can favorably be performed.

The difference in speed may also be provided by moving the charging member in the same direction as the direction of movement of the photosensitive member surface. However, the charging performance in the direct-injection charging depends on the ratio of the peripheral speed of the photosensitive member to the peripheral speed of the charging member. Hence, in order to attain the same peripheral ratio as that in the case of opposite direction, the number of rotation of the charging member rotated in the same direction must be made larger than the case of opposite direction. Thus, in view of the number of rotation, it is more advantageous to move the charging member in the opposite direction.

As an index to show the difference in relative speed, a relative movement speed ratio represented by the following equation (I) is available.

Equation (I)

$$\text{Relative movement speed ratio } (\%) = |(Vc - Vp)/Vp| \times 100$$

(In the equation, Vc is the movement speed of the charging member surface, Vp is the movement speed of the photosensitive member surface, and the Vc is the value to be represented by the same plus or minus sign as that of Vp when the charging member surface moves in the same direction as the photosensitive member surface at their contact zone).

The relative movement speed ratio may usually be from 10 to 500%.

FIG. 5 shows a cleanerless image-forming apparatus. The latent image formed by charging and exposure is rendered visible by means of the developing assembly 506 as the developing means, and is transferred to a transfer medium by a transfer means (not shown). In that course, the transfer residual toner remaining on the photosensitive member 503 is charged by the elastic-roller charging member and thereafter again reaches the developing assembly 506, where it is collected simultaneously with the development. In the apparatus shown in FIG. 5, the conductive fine powder 505 interposed between the charging member and the photosensitive member is externally added to the toner, and the conductive fine powder 505 having remained on the photosensitive member 503 surface reaches the charging assembly, where it replenishes the conductive fine powder.

Figure 6:
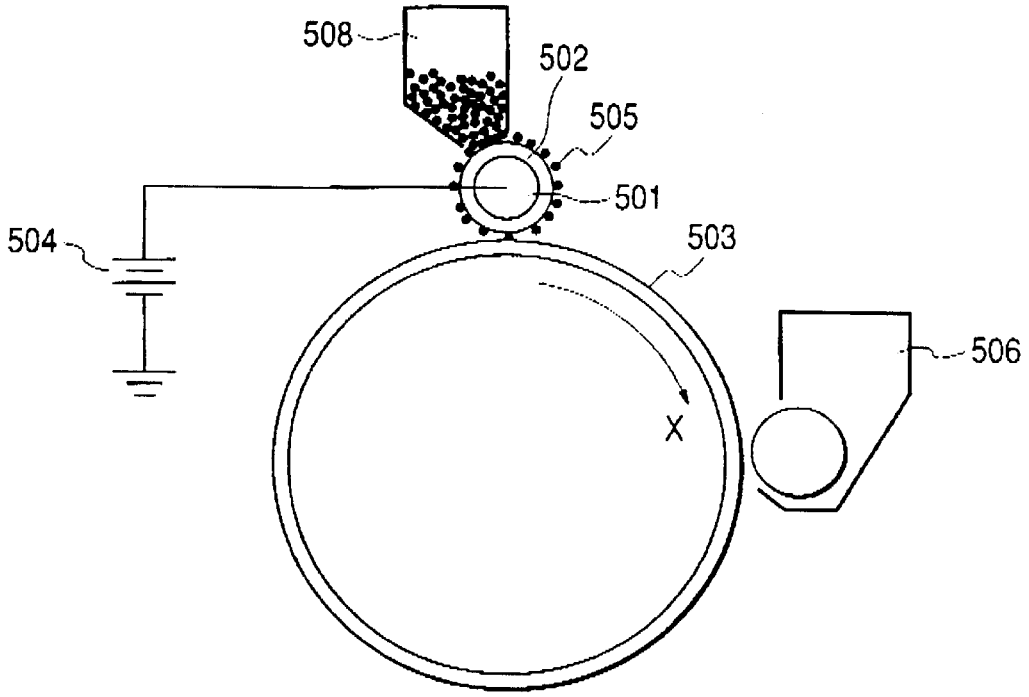
FIG. 6 is a schematic illustration of still another example of a contact charging unit used in the image-forming apparatus of the present invention.

A charging means may also be preferable which is so constructed that a conductive fine powder replenishing means for supplying the conductive fine powder is further provided at the upper part of the charging member. FIG. 6 schematically illustrates such a charging means provided with a conductive fine powder replenishing means 508 at the upper part of the charging member in the same charging unit as that shown in FIG. 5.

The conductive fine powder may preferably have a resistivity of $1\times10^{9}\Omega\cdot$cm or lower. If the conductive fine powder has a resistivity higher than $1\times10^{9}\Omega\cdot$cm, the effect of accelerating charging for the achievement of good charging performance tends to be not obtainable even when the conductive fine powder is interposed at the part of contact between the charging member and the electrophotographic photosensitive member or at a charging region vicinal to that part.

The conductive fine powder may on the other hand have a resistivity of $1\times10^{-1}\Omega\cdot$cm or higher. This is preferable because in this case the conductive fine powder comes to hold charges and moves to non-image areas in the developing step and in consequence, it accelerates the charging of the photosensitive member in the subsequent charging step.

The conductive fine powder may preferably have a volume-average particle diameter of from 0.5 to 10 $\mu$m. If the conductive fine powder has a small average particle diameter, the content of the conductive fine powder with respect to the whole toner must be set small in order to prevent developing performance from lowering. From this point of view, the conductive fine powder may preferably have a volume-average particle diameter of 0.8 $\mu$m or larger, and more preferably 1.1 $\mu$m or larger. Also, if the conductive fine powder has a volume-average particle diameter larger than 10 $\mu$m, the conductive fine powder having come off from the charging member may intercept or diffuse the exposure light with which electrostatic latent images are written, tending to cause defects in electrostatic latent images to lower image quality level.

The conductive fine powder may also be a transparent, white or pale-color conductive fine powder. This is preferable because the conductive fine powder transferred onto the transfer medium is not conspicuous as fog. In the sense that it does not obstruct the exposure light in the step of forming latent images, too, the conductive fine powder may preferably be such a transparent, white or pale-color conductive fine powder, and the conductive fine powder may more preferably have a transmittance of 30% or higher to the exposure light.

As materials for the conductive fine powder in the present invention, usable are, e.g., fine carbon powders such as carbon black and graphite powder; fine powders of metals such as copper, gold, silver, aluminum and nickel; fine powders of metal oxides such as zinc oxide, titanium oxide, tin oxide, aluminum oxide, indium oxide, silicon oxide, magnesium oxide, barium oxide, molybdenum oxide, iron oxide and tungsten oxide; and fine powders of metal compounds such as molybdenum sulfide, cadmium sulfide and potassium titanate, or double oxides of these; any of which may be used under optional regulation of particle size and particle size distribution. Of these, fine powders of metal oxides such as zinc oxide, tin oxide and titanium oxide are preferred.

For the purpose of controlling resistance value of conductive inorganic oxides, also usable are fine particles of metal oxides doped with an element such as antimony or aluminum, and fine particles having a conductive material on their surfaces. For example, they are fine titanium oxide particles surface-treated with tin-antimony oxide, fine stannic oxide particles doped with antimony, and fine stannic oxide particles.

The volume-average particle diameter and particle size distribution of the conductive fine powder in the present invention can be measured with an LS-230 type laser diffraction particle size distribution measuring instrument, manufacture by Coulter Co., fitted with a liquid module, and in the measurement range of 0.04 to 2,000 $\mu$m, As a measuring method, a method is available in which a surface-active agent is added in a very small quantity to 10 ml of pure water. 10 mg of a conductive fine powder sample is added thereto, the mixture formed is dispersed for 10 minutes by means of an ultrasonic dispersion machine (ultrasonic homogenizer) and thereafter measurement is made once for a measurement time of 90 seconds.

In the present invention, as methods of regulating the particle size and particle size distribution of the conductive fine powder, usable are a method in which a production process and production conditions are so set that the desired particle size and particle size distribution are attained when primary particles of the conductive fine powder are produced, and besides a method in which particles having a small primary particle diameter are agglomerated, a method in which particles having a large primary particle diameter are pulverized, or a method making use of classification. Also usable are a method in which the conductive fine powder is made to adhere or fix to part or the whole of surfaces of base particles (particles serving as a base when the conductive material is made to adhere or fix in preparing the conductive fine powder) having the desired particle size and particle size distribution, and a method in which a conductive fine powder having such a form that a conductive component has been dispersed in particles having the desired particle size and particle size distribution. Any of these methods may also be used in combination to regulate the particle size and particle size distribution of the conductive fine powder.

In the case when the particles of the conductive fine powder are made up in the form of agglomerates, the average particle diameter of the agglomerates is defined as the volume-average particle diameter of the conductive fine powder. The conductive fine powder not only may be present in the state of primary particles, but also may be present in the state of agglomerated primary particles without any problem. Whatever the state of agglomeration it has, its form does not matter as long as it is interposed as agglomerates at the part of contact between the charging member and the photosensitive member or at a charging region vicinal to that part and the function of discharge assistance or acceleration can be materialized.

In the present invention, the resistivity of the conductive fine powder can be measured by the tablet method and normalizing the measured values to determine the resistivity. More specifically, about 0.5 g of a conductive fine powder sample is put into a cylinder of 2.26 $cm^2$ in bottom area, and a pressure of 15 kg is applied to upper and lower electrodes and simultaneously a voltage of 100 V is applied to measure the resistance value. Thereafter, the measured values are normalized to calculate specific resistance.

[4] Toner in the Present Invention

The toner in the present invention is a magnetic toner comprising toner particles containing at least a binder resin and a magnetic material, and an inorganic fine powder. The toner used in the present invention does not require any limitations to its production process as long as the conditions of the present invention described later are fulfilled. Any production processes known conventionally may be used. Such toner production processes can be exemplified by a pulverization process and a polymerization process.

In the case when the toner is produced by pulverization, any known method may be used. For example, components necessary as the toner, such as a binder resin, a magnetic material, a release agent, a plasticizer, a charge control agent and a colorant and other additives are thoroughly mixed by mean of a mixer such as a Henschel mixer or a ball mill, thereafter the mixture obtained is melt-kneaded by means of a heat kneading machine such as a heat roll, a kneader or an extruder to make resins melt one another, other toner materials such as a magnetic material are dispersing or dissolved, and the resultant product is cooled to solidify, followed by pulverization, classification and optionally surface treatment to obtain toner particles. Either of the classification and the surface treatment may be first in order. In the step of classification, a multi-division classifier may preferably be used in view of production efficiency.

The pulverization step may be carried out by any method making use of a known pulverizer such as a mechanical impact type or a jet type. In order to obtain toner particles having a specific circularity according to the present invention, described later, it is preferable to further apply heat to effect pulverization or to add mechanical impact auxiliarily to make treatment. Also usable are a hot-water bath method in which toner particles finely pulverized (and optionally classified) are dispersed in hot water, and a method in which such toner particles are passed through hot-air streams.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo K.K., and a method in which toner particles are pressed against the inner wall of a casing by centrifugal force by means of a high-speed rotating blade to impart mechanical impact to the magnetic toner particles by the force such as compression force or frictional force, as exemplified by apparatus such as a mechanofusion system manufactured by Hosokawa Mikuron K.K. or a hybridization system manufactured by Nara Kikai Seisakusho.

When such a mechanical impact method is used, thermo-mechanical impact where heat is applied at a temperature around glass transition temperature (Tg) of the magnetic toner particles (Tg±10° C.) as treatment temperature is preferred from the viewpoint of prevention of agglomeration and productivity. More preferably the heat may be applied at a temperature within ±5° C. of the glass transition temperature (Tg) of the magnetic toner particles, as being effective for the improvement of transfer efficiency.

The toner used in the present invention may be produced by pulverization as described previously. However, the toner particles obtained by such pulverization commonly have an amorphous shape, and hence any mechanical and thermal or any special treatment must be made in order to attain preferable physical properties, an average circularity of 0.950 or more, which is an essential requirement for the toner according to the present invention as will be detailed later. Accordingly, in the present invention, the toner particles may preferably be produced by suspension polymerization.

In this suspension polymerization, a polymerizable monomer and a colorant (and also optionally a polymerization initiator, a cross-linking agent, a charge control agent and other additives) are uniformly dissolved or dispersed to form a polymerizable monomer composition, and thereafter this polymerizable monomer composition is dispersed in a continuous phase (e.g., an aqueous phase) containing a dispersion stabilizer, by means of a suitable stirrer to simultaneously carry out polymerization to obtain toner particles having the desired particle diameters. In the toner obtained by this suspension polymerization (hereinafter also "polymerization toner"), its individual toner particles stand uniform in a substantially spherical shape, and hence the toner which satisfies the requirement on physical properties, the average circularity of 0.950 or more, which is essential for the present invention can be obtained with ease. Moreover, such a toner can also have a relatively uniform charge quantity distribution, and hence has a high transfer performance.

In the process of producing the toner particles according to the present invention by polymerization, a magnetic material, a wax, a plasticizer, a charge control agent, a cross-linking agent, components necessary as the toner in some cases, such as a colorant and other additives, e.g., an organic solvent added in order to lower the viscosity of a polymer formed by the polymerization reaction, a high-molecular polymer, a dispersant and so forth are appropriately added, and are dissolved or dispersed by means of a dispersion machine such as a homogenizer, a ball mill, a colloid mill or an ultrasonic dispersion machine to form a polymerizable monomer composition, which is then suspended in an aqueous medium containing a dispersion stabilizer. Here, a high-speed dispersion machine such as a high-speed stirrer or an ultrasonic dispersion machine may be used to make the toner particles have the desired particle size without delay, and this can more readily make the resultant toner particles have a sharp particle size distribution. As the time at which the polymerization initiator is added, it may be added simultaneously when other additives are added in the polymerizable monomer, or may be mixed immediately before they are suspended in the aqueous medium. Also, a polymerization initiator having been dissolved in the polymerizable monomer or solvent may be added before the polymerization is initiated. As these materials, the following materials may be used which are usually used in the production of toners.

The toner used in the present invention has toner particles containing at least a binder resin and a magnetic material, and an inorganic fine powder. As the binder resin, it may include polystyrene; homopolymers of styrene derivatives such as polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-malcate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins. Any of these may be used alone or in combination of two or more types.

The polymerizable monomer preferably used in the suspension polymerization may include, e.g., styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in combination of two or more types. Of the foregoing monomers, styrene or a styrene derivative may preferably be used alone or in the form of a mixture with other monomer, in view of developing performance and running performance of the toner.

The polymerization initiator, usable when the above polymerizable monomer(s) is/are polymerized, may include, e.g., azo or diazo type polymerization initiators such as 2,2'-azobis-(2,4-dimethylvaleronitrile),
2,2'-azobisisobutyronitrile,
1,1'-azobis-(cyclohexane-1-carbonitrile), and
2,2'-azobis-4-methoxy-2,4-dimethylvaleronitrile; and peroxide type polymerization initiators such as benzoyl peroxide, methyl ethyl ketone peroxide, diisopropylperoxy carbonate, cumene hydroperoxide,
2,4-dichlorobenzoyl peroxide, lauroyl peroxide and t-butyl peroxy-2-ethyl hexanoate. Any of these may be used alone or in combination of two or more types.

As the cross-linking agent, usable when the above polymerizable monomer(s) is/are polymerized, compounds chiefly having at least two polymerizable double bonds may be used, which are conventionally known cross-linking agents of various types. It may include, e.g., aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in combination of two or more types.

As the dispersion stabilizer, usable preferably in the suspension polymerization, any known surface-active agent and organic or inorganic dispersant may be used.

The surface-active agent may include, e.g., sodium dodecylbenzenesulfonate, sodium tetradecyl sulfate, sodium pentadecyl sulfate, sodium octyl sulfate, sodium oleate, sodium laurate, sodium stearate and potassium stearate. Any of these may be used alone or in combination of two or more types.

The organic dispersant may include, e.g., polyvinyl alcohol, gelatin, methyl cellulose, methyl hydroxypropyl cellulose, ethyl cellulose, carboxymethyl cellulose sodium salt, polyacrylic acid and salts thereof, and starch. Any of these may be used alone or in combination of two or more types.

The inorganic dispersant may include, e.g., phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina. Any of these may be used alone or in combination of two or more types.

In the toner used in the present invention, a wax which regulates releasability and plasticity may be used. Such a wax may include petroleum waxes such as paraffin wax, microcrystalline wax and petrolatum and derivatives thereof, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes. Any of these may be used alone or in combination of two or more types.

In the toner used in the present invention, a charge control agent which controls the chargeability of the toner may be used. Such a charge control agent may include, as negative charge control agents, e.g., metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; and polymer type compounds having sulfonic acid or carboxylic acid in the side chain; as well as boron compounds, urea compounds, silicon compounds, and carixarene. Any of these may be used alone or in combination of two or more types. As positive charge control agents, they may include, e.g., quaternary ammonium salts, polymer type compounds having such a quaternary ammonium salt in the side chain, guanidine compounds, nigrosin compounds and imidazole compounds. Any of these may be used alone or in combination of two or more types.

In the toner used in the present invention, a colorant may optionally be used. Such a colorant may include, e.g., magnetic or non-magnetic inorganic compounds and known dyes and pigments. Stated more specifically, it may include, e.g., ferromagnetic metal particles such as cobalt and nickel, or alloys of any of these metals to which element(s) such as chromium, manganese, copper, zinc, aluminum and/or rare earth element(s) has or have been added; as well as hematite particles, titanium black, nigrosine dyes or pigments, carbon black, and phthalocyanines. Any of these may be used alone or in combination of two or more types. Also, the colorant may be used after it has been subjected to hydrophobic treatment like the magnetic material or inorganic fine powder described later.

As the magnetic material contained in the toner used in the present invention, any known magnetic material may be used. Such a magnetic material may include, e.g., those composed chiefly of an iron oxide such as triiron tetraoxide or γ-iron oxide. Any of these may be used alone or in combination of two or more types. The magnetic material may further contain any of other elements such as phosphorus, cobalt, nickel, copper, magnesium, manganese, aluminum and silicon. Incidentally, the saturation magnetization may be regulated by selecting the type of the magnetic material to be used and the amount of the magnetic material to be mixed.

It is preferable for the magnetic material to have been hydrophobic-treated on its particle surfaces. It may be hydrophobic-treated with a known treating agent and by a known method. The treating agent used in such hydrophobic treatment may include coupling agents such as silane coupling agents and titanium coupling agents, which combine with particle surfaces of the magnetic material while hydrolyzing in an aqueous medium. In particular, silane coupling agents are preferred. Such silane coupling agents may include, e.g., vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane. Any of these may be used alone or in combination of two or more types.

In the step of polymerization, the polymerization may be carried out at a polymerization temperature set at 40° C. or above, and commonly at a temperature of from 50 to 90° C. Where the polymerization is carried out in this temperature range, the wax becomes more favorably enclosed in particles. In order to consume residual polymerizable monomers, the reaction temperature may be raised to 90 to 150° C. if it is done at the termination of polymerization reaction.

The toner particles according to the present invention may also be produced by a dispersion polymerization method in which toner particles are directly produced using an aqueous organic solvent capable of dissolving monomers and not capable of dissolving the resulting polymer, a method of producing toner particles by an emulsion polymerization method as typified by soap-free polymerization in which toner particles are produced by direct polymerization in the presence of a water-soluble polar polymerization initiator, or a method in which polymer particles obtained by emulsion polymerization are subjected to association agglomeration.

After the polymerization has been completed, the resultant polymerization toner particles may be subjected to filtration, washing and drying by conventional methods, followed by blending with the inorganic fine powder to make it adhere to particle surfaces to obtain the toner. Also, it is one of desirable forms of the present invention to add the step of classification to cut coarse powder and fine powder.

The magnetic toner in the present invention may preferably have an average circularity of from 0.950 to 1.000, more preferably from 0.950 to 0.995. and still more preferably from 0.970 to 0.995.

The average circularity referred to in the present invention is used as a simple method for expressing the shape of toner quantitatively. In the present invention, the shape of particles is measured with a flow type particle image analyzer FPIA-1000, (Ci) is individually calculated on a group of particles having a circle-equivalent diameter of 3 μm or larger, according to the following Equation (II). As also further shown in the following Equation (III), the value obtained when the sum total of circularity of all particles measured is divided by the number (m) of all particles is defined to be the average circularity (C).

$$\text{Circularity } (Ci) = \frac{\text{Circumferential length of a circle with the same area as particle image}}{\text{Circumferential length of particle projected image}} \quad \text{Equation (II)}$$

$$\text{Average circularity } (C) = \sum_{i=1}^{m} Ci/m \quad \text{Equation (III)}$$

The measuring device "FPIA-1000" used in the present invention employs a calculation method in which, in calculating the circularity of each particle and thereafter calculating the average circularity, particles are divided into 61 classes as circularities of from 0.40 to 1.00, in accordance with the corresponding circularities, and the average circularity are calculated using the center values and frequencies of divided points. Between the values of the average circularity calculated by this calculation method and the values of the average circularity calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

The measurement is specifically made in the manner as shown below.

In 10 ml of water in which about 0.1 mg of a surface-active agent has been dissolved, about 5 mg of the toner is dispersed to prepare a dispersion. Then the dispersion is exposed to ultrasonic waves (20 kHz, 50 W) for 5 minutes and the dispersion is made to have a concentration of 5,000 to 20,000 particles/$\mu$l, where the measurement is made using the above analyzer to determine the average circularity of the group of particles having a circle-equivalent diameter of 3 $\mu$m or larger.

The average circularity referred to in the present invention is an index showing the degree of surface unevenness of toner particles. It is indicated as 1.000 when the toner particles are perfectly spherical. The more complicate the surface shape of toner particles is, the smaller the value of average circularity is. Incidentally, in this measurement, the reason why the circularity is measured only on the group of particles having a circle-equivalent diameter of 3 $\mu$m or larger is that a group of particles of external additives that is present independently from toner particles are included in a large number in a group of particles having a circle-equivalent diameter smaller than 3 $\mu$m, which may affect the measurement not to enable any accurate estimation of the circularity on the group of toner particles.

The toner in the present invention has the inorganic fine powder on its toner particles by blending the above toner particles with the inorganic fine powder. The inorganic fine powder used in the toner may preferably be in an amount of from 0.1 to 3.0% by weight based on the total weight of the toner. If it is in an amount less than 0.1% by weight, the effect (such as improvement of a fluidity and charging performance of the toner) attributable to such external addition of the inorganic fine powder can not well be brought out in some cases. If it is blended in an amount more than 3.0% by weight, a poor fixing performance may result.

The inorganic fine powder thus used may include, e.g., fine silica powder, fine alumina powder and fine titania powder, which may be used alone or in combination of two or more types. Stated more specifically, as the fine silica powder for example, usable are what is called dry-process silica or fumed silica produced by vapor phase oxidation of silicon halides and what is called wet-process silica produced from water glass, either of which may be used. The dry-process silica is preferred, as having less silanol groups on the surface and inside of particles of the fine silica powder and leaving less production residues such as $Na_2O$ and $SO_3^{2-}$. In the dry-process silica, it is also possible to use, in its production step, other metal halide compound as exemplified by aluminum chloride or titanium chloride together with the silicon halide to give a composite fine powder (double oxide) of silica with other metal oxide. The Inorganic fine powder includes these, too.

The inorganic fine powder may also preferably be a powder having been hydrophobic-treated. A hydrophobic-treating agent used for hydrophobic-treating the inorganic fine powder may include treating agents such as silicone varnish, modified silicone varnish of various types, silicone oil, modified silicone oil of various types, silane compounds, silane coupling agents, other organic silicon compounds and organic titanium compounds, any of which may be used alone or in combination for the treatment. In particular, those having been treated with silicone oil are preferred.

As a method for treating the inorganic fine powder with the silicone oil, stated specifically, for example the inorganic fine powder having been treated with a silane compound and the silicone oil may directly be mixed by means of a mixer such as a Henschel mixer, or a method may be used in which the silicone oil is sprayed on the inorganic fine powder. Alternatively, a method may be used in which the silicone oil is dissolved or dispersed in a suitable solvent and thereafter the inorganic fine powder is added and mixed, followed by removal of the solvent. In view of an advantage that agglomerates of the inorganic fine powder may relatively less occur, the method making use of a sprayer is preferred.

As the silicone oil used, particularly preferred are, e.g., dimethylsilicone oil, methylphenylsilicone oil, $\alpha$-methylstyrene-modified silicone oil, chlorophenylsilicone oil and fluorine-modified silicone oil.

The magnetic toner in the present invention may preferably have a saturation magnetization of from 10 to 50 $Am^2/kg$ (emu/g) under application of a magnetic field of 79.6 kA/m (1,000 oersteds). However, if the magnetic toner has a saturation magnetization lower than 10 $Am^2/kg$ under application of a magnetic field of 79.6 kA/m, any intended effect is not obtainable, and, where a magnetic force is made to act on the toner-carrying member, the toner may unstably be formed into ears, tending to cause faulty images such as fog and uneven image density and faulty collection of transfer residual toner which are ascribable to non-uniform charging to the magnetic toner. If on the other hand the magnetic toner has a saturation magnetization higher than 50 $Am^2/kg$ under application of a magnetic field of 79.6 kA/m, the toner may have a low fluidity because of magnetic agglomeration to cause a great lowering of the fluidity of the toner. This may cause a lowering of transfer performance to cause an increase in transfer residual toner, and also may make stronger the tendency for the toner particles and conductive fine powder to behave jointly to lessen the conductive fine powder adhering to and mixing in the contact charging member and standing interposed at the contact zone, and at the same time lessen the conductive fine powder interposed at the contact zone, as its quantity with respect to the quantity of transfer residual toner, tending to cause fog and image stains because of a lowering of charging performance.

In the present invention, the intensity of magnetization (saturation magnetization) of the magnetic toner is measured with a vibration type magnetic-force meter VSM P-1-10 (manufactured by Toei Kogyo K.K.) under application of an external magnetic field of 79.6 kA/m at room temperature of 25° C. Incidentally, in the present invention, the saturation magnetization of the toner is prescribed in the magnetic field of 79.6 kA/m. In the case when the magnetic toner is applied in the image-forming apparatus, the magnetic filed acting on the magnetic toner is set at tens to hundred and tens of kA/m in many commercially available image-forming apparatus in order not to greatly cause any leakage of the magnetic field to the outside of the image-forming apparatus or in order to cut down the cost for magnetic-field generation sources. Accordingly, in the present invention, the magnetic field of 79.6 kA/m (1,000 oerstads) is selected as a typical value of the magnetic filed acting actually on the magnetic toner in the image-forming apparatus. Thus, the saturation magnetization of the toner in the magnetic field of 79.6 kA/m is prescribed here.

In the magnetic toner in the present invention, it is also preferable to add the conductive fine powder externally to the toner particles. In the present invention, the conductive fine powder may preferably be in a content of from 0.2 to 10% by weight based on the weight of the whole magnetic toner. Since in the magnetic toner of the present invention the magnetic material stands substantially uncovered to the particle surfaces, it is so highly chargeable as to tend to lower the developing performance if the conductive fine powder is in a content smaller than 0.2% by weight based on the weight of the whole magnetic toner. Also, where it is used in an image-forming method making use of cleaning-at-development, the conductive fine powder can not be interposed at the part of contact between the charging member and the photosensitive member or at a charging region vicinal to that part, in a quantity sufficient for allowing the contact charging member to well perform the charging of the image-bearing member photosensitive member by overcoming any inhibition of charging that may be causeed by the insulative transfer residual toner adhering to and mixing in the contact charging member. As the result, the charging performance may lower to cause faulty charging. If on the other hand it is in a content more than 10% by weight, the conductive fine powder collected by the cleaning-at-development may become too much. This may lower the charging performance and developing performance of the toner at the development zone to cause a decrease in image density and toner scatter. The conductive fine powder may more preferably be in a content of from 0.5 to 5% by weight based on the weight of the whole magnetic toner.

[4] Image-Forming Method and Image-Forming Apparatus of the Present Invention

The image-forming method of the present invention may be the same method as any conventional methods except for using the above electrophotographic photosensitive member, charging means and magnetic toner according to the present invention.

An embodiment of the image-forming apparatus of the present invention is described with reference to FIG. 7. The present invention is by no means limited to this. Also, the image-forming apparatus of the present invention has the same means as any means used in known image-forming apparatus except for using the above electrophotographic photosensitive member, charging means and magnetic toner according to the present invention.

Figure 7:
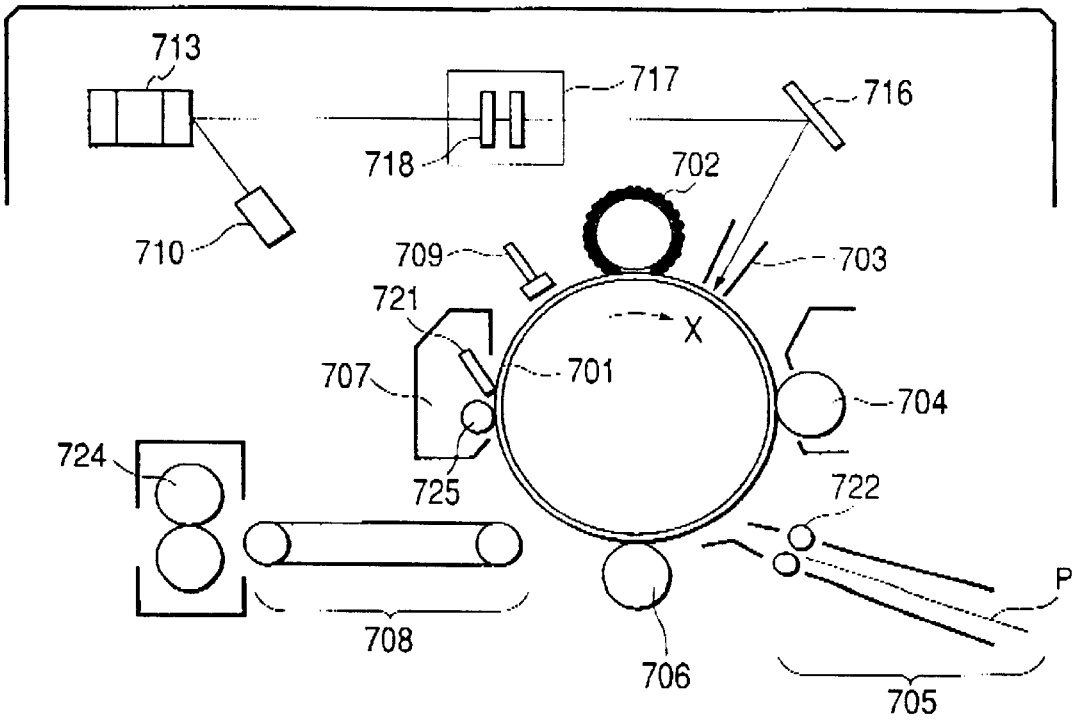
FIG. 7 is a schematic illustration of an example of the image-forming apparatus of the present invention.

FIG. 7 schematically illustrates an example of an image-forming process in the image-forming apparatus of the present invention. An electrophotographic photosensitive member 701 comprises an a-C:H surface layer having a dynamic hardness of from $4.90\times10^9$ to $1.76\times10^{10}$ Pa (500 to 1,800 kgf/mm$^2$), and is rotated in the direction of an arrow X. The electrophotographic photosensitive member 701 is provided around it with a contact charging assembly 702 according to the present invention, an electrostatic latent image forming means 703, a developing assembly 704, a transfer medium feed system 705, a transfer means transfer roller 706, a cleaner 707, a transport system 708 and a charge elimination light source 709.

The image-forming process is specifically described below. The electrophotographic photosensitive member 701 is uniformly electrostatically charged by the contact charging assembly 702 to which a negative direct-current voltage is kept applied. Laser light emitted from a semiconductor laser 710 which is driven in accordance with image information having been read by a scanner or image information inputted from a computer reflects from a polygon mirror 713, and an image is formed through a lens 718 of a lens unit 717. This image is led onto the electrophotographic photosensitive member 701 via a mirror 716 and projected thereon, thus an electrostatic latent image is formed. To this latent image, a toner with negative polarity is fed from the developing assembly 704, so that a toner image is formed.

Meanwhile, a transfer medium P is fed toward the electrophotographic photosensitive member 701 while its leading-end timing is regulated by a registration roller 722. The transfer medium P is provided from its back with an electric field having a polarity opposite to that of the toner, at a gap between the transfer roller 706 to which a high voltage is kept applied and the electrophotographic photosensitive member 701. Thus, the toner image on the electrophotographic photosensitive member surface is transferred to the transfer medium P. Next, the transfer medium P passes through the transfer medium transport system 708 to reach a fixing assembly 712, where the toner image is fixed, and then delivered out of the apparatus.

The toner remaining on the electrophotographic photosensitive member 701 is collected with a magnet roller 725 and a cleaning blade 721 which are provided in the cleaning unit (cleaner) 707. The remaining electrostatic latent image is erased by the charge elimination light source 709.

In the image-forming method of the present invention, the developing step may also serve as a cleaning step for collecting the toner having remained on the photosensitive member after the toner image has been transferred onto the transfer medium to afford an image-forming method having a cleaning-at-development step or a cleanerless step. Such a method is also preferred.

In such a cleaning-at-development image-forming method or cleanerless image-forming method, it may further preferably be an image-forming method in which the developing step is the step of developing with the toner the electrostatic latent image formed on the photosensitive member, the charging step is the step of charging the photosensitive member upon application of a voltage to the charging member kept in contact with the photosensitive member, forming a contact zone, and, at least at the part of contact (contact zone) between the charging member and the photosensitive member and/or in the vicinity thereof, the conductive fine powder contained in the magnetic toner or the conductive fine powder fed from the conductive fine powder replenishing means of the charging means adheres to the photosensitive member in the developing step, and remains on the photosensitive member also after the transfer step to become carried to and interposed at the contact zone.

EXAMPLES

The present invention is described below in greater detail by giving Examples. The present invention is by no means limited to these Examples. In the following, physical properties measured in Examples are measured by the same methods as the methods described in the above embodiments. Also, in the present Examples, "part(s)" is "part(s) by weight".

Example 1

—Production of Photosensitive Member—

Using the apparatus for producing the a-Si photosensitive member by RF plasma-assisted CVD method as shown in FIG. 2, a lower-part blocking layer, a photoconductive layer and a buffer layer were superposingly formed on a mirror-finished aluminum cylinder as a conductive substrate, in the manner as described in the photosensitive member production process in the above embodiments and under conditions shown below. A surface layer comprised of a-C:H was further formed thereon to produce a-Si photosensitive members (A) to (F) having surface layers with different dynamic hardness. Here, the frequency of RF power used was 13.56 MHz.

| | |
|---|---|
| (1) Lower-part blocking layer: | |
| $SiH_4$ | 100 ml/min (normal*)<br>*(0° C., atmospheric pressure) |
| $H_2$ | 500 ml/min (normal) |
| NO | 8 ml/min (normal) |
| $PH_3$ | 1,500 ppm (based on $SiH_4$) |
| Power | 100 W |
| Discharge space pressure | 67 Pa |
| Substrate temperature | 300° C. |
| Layer thickness | 2 μm |
| (2) Photoconductive layer: | |
| $SiH_4$ | 200 ml/min (normal) |
| $H_2$ | 500 ml/min (normal) |
| Power | 500 W |
| Discharge space pressure | 67 Pa |
| Substrate temperature | 300° C. |
| Layer thickness | 30 μm |
| (3) Buffer layer: | |
| $SiH_4$ | 50 ml/min (normal) |
| $CH_4$ | 450 ml/min (normal) |
| $B_2H_3$ | 800 ppm (based on $SiH_4$) |
| Power | 300 W |
| Discharge space pressure | 67 Pa |
| Substrate temperature | 300° C. |
| Layer thickness | 0.5 μm |
| (4) Surface layer: | |
| $CH_4$ | 200 ml/min (normal) |
| Power | (A) 500 W, (B) 700 W, (C) 900 W,<br>(D) 1,100 W, (E) 1,300 W, (F) 1,500 W |
| Discharge space pressure | 67 Pa |
| Substrate temperature | 50° C. |
| Layer thickness | 0.3 μm |

—Production of Toner—

Next, polymerization toner (1) was produced in the following way.

Into 709 g of ion-exchanged water, 451 g of an aqueous 0.1M-$Na_3PO_4$ solution was introduced, and the mixture was heated to 60° C. Thereafter, 67.7 g of an aqueous 1.0M-$CaCl_2$ solution was added thereto little by little to obtain an aqueous medium containing $Ca_3(PO_4)_2$.

| | |
|---|---|
| Styrene | 80 parts |
| n-Butyl acrylate | 20 parts |
| Unsaturated polyester resin | 2 parts |
| Saturated polyester resin | 3 parts |
| Negative charge control agent (monoazo dye type Fe compound) | 1 part |
| Surface hydrophobic-treated magnetic material | 90 parts |

The above materials were uniformly dispersed and mixed by means of an attritor (manufactured by Mitsui Miike Engineering Corporation) to obtain a monomer composition. This monomer composition was heated to 60° C., and 6 parts of ester wax (maximum value of endothermic peak in DSC: 72° C.) composed chiefly of behenyl behenate was added thereto and mixed to become dissolved. In the mixture obtained, 5 parts of a polymerization initiator. 2,2'-azobis (2,4-dimethylvaleronitrile) ($t_{1/2}$=140 minutes, under 60° C. condition) was dissolved to prepare a polymerizable monomer composition.

The polymerizable monomer composition thus obtained was introduced into the above aqueous medium, followed by stirring at 10,000 rpm for 15 minutes at 60° C. in an atmosphere of $N_2$ by means of the TK-type homomixer (manufactured by Tokushu Kika Kogyo Co., Ltd.) to carry out granulation. Thereafter, with stirring with paddle stirring blades, the reaction was carried out at 60° C. for 6 hours. Then, the liquid temperature was raised to 80° C., and the stirring was further continued for 4 hours. After the reaction was completed, distillation was further carried out at 80° C. for 2 hours. Thereafter the suspension formed was cooled, and hydrochloric acid was added to dissolve the $Ca_3(PO_4)_2$, followed by filtration, washing with water and drying to obtain toner particles having a weight-average particle diameter of 6.5 μm.

100 parts of the toner particles thus obtained and 1.2 parts of hydrophobic fine silica powder obtained by surface-treating silica of 8 nm in primary particle diameter with hexamethyldisilazane and having a BET specific surface area of 250 $mm^2/g$ after the treatment were mixed by means of a Henschel mixer (manufactured by Mitsui Miike Engineering Corporation) to prepare the polymerization toner (1). The toner thus obtained had an average circularity of 0.983 and an intensity of magnetization (saturation magnetization) under application of a magnetic field of 79.6 kA/m, of 28 $Am^2/kg$.

—Image-Forming Apparatus—

The a-Si photosensitive member and polymerization toner (1) produced in the manner described above were set in the image-forming apparatus shown in FIG. 7. In this apparatus, the magnetic-brush charging assembly shown in FIG. 4 in the above embodiments was attached as the charging assembly. Here, the process speed was set at 400 mm/s; and the relative speed of the photosensitive member to the magnetic brush, 120% in opposite direction.

Magnetic particles used in the magnetic-brush charging assembly in the present Example were produced in the following way.

0.05% by weight of phosphorus was added to a mixture of 50 mole % of $Fe_2O_3$, 25 mole % of CuO and 25 mole % of ZnO, and a dispersant, a binder and water were added thereto. These were dispersed and mixed by means of a ball mill, followed by granulation by means a spray dryer and then molding. Next, the molded product obtained was fired for 6 hours under conditions of 1,150° C. The fired product obtained was disintegrated, followed by classification (using a dispersion separator) to obtain ferrite particles of 35 μm in volume-average particle diameter.

In 100 parts of the magnetic particles obtained as described above, 0.10 part of a titanium coupling agent (isoproxytriisostearoyl titanate) was mixed by the aid of a toluene solvent, followed by wet-process coating and then curing at 170° C. in an electric oven. The volume resistivity of the resultant magnetic particles was $3.5\times10^{7}\Omega\cdot$cm.

Evaluation was made on the photosensitive members (A) to (F) in the following way in respect of dynamic hardness, abrasion level, coarse images, halftone unevenness, fine-line reproducibility, image resolution (resolving power), and adherence. Hydrogen content was also measured.

(Dynamic Hardness)

After the following evaluation has all been finished, photosensitive member pieces were cut out in a size of 3 cm×3 cm each, and their dynamic hardness was measured with the dynamic hardness meter DUH-201S, manufactured by Shimadzu Corporation. As its diamond penetrator, a triangular conical penetrator having a dihedral angle of 115° was used. Also, the depth of indentation was so set as to be ⅕ or less of the thickness of the surface layer to prevent from being affected by the underlying layer.

(Abrasion Level)

A 100,000-sheet running test was made using A4-size paper. Here, the layer thickness of the surface layer was measured before and after the running test to measure its abrasion level. Then, the results were evaluated by four ranks according to the following criteria.

A: Within a measurement error, and no abrasion is detectable; very good.

B: Abrasion level is 5% or less; good.

C: Abrasion level is more than 5%, but at a level not problematic in practical use at all.

D: Abrasion occurred remarkably.

(Coarse Images)

After the above 100,000-sheet running test was finished, copies of a sample chart of a portrait image were taken, and the copied images obtained were visually checked with a magnifier of 10 magnifications. Then, the results were evaluated by four ranks according to the following criteria.

A: No coarse images are seen even when observed with the magnifier of 10 magnifications; very good.

B: Coarse images are slightly seen when observed with the magnifier of 10 magnifications, but are not seen when observed visually; good.

C: Coarse images are slightly seen at some part when observed visually, but at a level not problematic in practical use.

D: Coarse images are conspicuously seen when observed visually.

(Halftone Unevenness)

Copies of a halftone chart were taken, and the image density of copied images was measured at five spots in the axial direction of the photosensitive member to make evaluation. Here, the image density was measured with an image densitometer (Macbeth RD914). Evaluation was made according to the following criteria.

A: Scattering of image density is less than 10%; very good.

B: Scattering of image density is 10% or more to less than 15%; good.

C: Scattering of image density is 15% or more to less than 20%.

D: Scattering of image density is more than 20%.

(Fine-Line Reproducibility)

The fine-line reproducibility was examined in the following way: Copies of an original image of fine lines drawn exactly in a width of 100 μm were taken under proper copying conditions, and the images obtained were used as samples for measurement. Using a Luzex 450-particle analyzer as a measuring instrument, the line width was measured with an indicator on an enlarged monitor image. Here, as positions at which the line width is measured, the fire-line images of toner had irregularities in their width direction, and hence average line width of such irregular lines was measured. From the measurements obtained, the value of fine-line reproducibility (%) was calculated according to the following expression.

Fine-line Reproducibility (%)=

(Line width of copied image, determined from measurement/original line width (100 μm))×100.

The closer to 100 the value obtained from this expression is, the better the reproducibility is.

A: Less than 110%; very good.

B: Less than 120%; good.

C; Less than 130%.

D: Not less than 130%.

(Image Resolution)

The resolution was measured in the following way: Original images were prepared in which 2.8, 3.2, 3.6, 4.0, 4.5, 5.0, 5.6, 6.3, 7.1 or 8.0 lines were each drawn in a space of 1 mm wide. Copies of an original having these ten kinds of fine lines were taken under proper copying conditions, and the images obtained were observed with a magnifier. The number of lines (lines/mm) of images where the spaces between fine lines looked clearly separate was regarded as the value of resolution. It means that, the larger its numeral is, the higher the resolution is.

A: Lines of 8.0 lines/mm are clearly seen; very good.

B: Lines of 6.3 lines/mm are clearly seen; good.

C: Lines of 5.0 lines/mm are clearly seen.

D: Lines of 5.0 lines/mm are not clearly seen (Adherence)

The surface of the electrophotographic photosensitive member on which the above evaluation was finished was streakily scratched in cross hatches at intervals of 1 cm using a sharp needle. This was immersed in water for a week, and thereafter taken out to visually examine whether or not any peeling of films occurred at the scratched portions.

A: No peeling occur at all; very good.

B: Peeling has grown from edges of streaky scratches to an extent that it is seen when observed with a magnifier of 10 magnifications, but no problem at all in practical use.

C: Slight peeling has spread from streaky scratches to an extent that it is seen when observed visually.

D: Peeling has occurred over a wide range.

(Hydrogen Content)

Samples of surface layers were formed on silicon wafers, and their infrared absorption spectra were measured with an infrared spectrophotometer. Then, in the case of a-C films, in-film hydrogen content was determined from the area of an absorption peak of C-Hn appearing at 2,920 $cm^{-1}$ vicinity and the layer thickness. Also, in the case of a-SiC films, in-film hydrogen content was determined by totaling in-film hydrogen content determined from an absorption peak of C-Hn appearing at 2,920 $cm^{-1}$ vicinity and in-film hydrogen content determined from an absorption peak of Si-Hn appearing at 2,000 $cm^{-1}$ vicinity.

Comparative Example 1

Using the apparatus for producing the a-Si photosensitive member by RF plasma-assisted CVD as shown in FIG. 2, a lower-part blocking layer, a photoconductive layer and a buffer layer were superposingly formed on a mirror-finished aluminum cylinder under the same conditions as those shown in Example 1. A surface layer comprised of a-C:H was further superposingly formed thereon under forming conditions shown below, to produce a-Si photosensitive members (G) and (H). Here, the frequency of RF power used was 13.56 MHz. On the photosensitive members (G) and (H) thus obtained, evaluation was made in the same manner as in Example 1.

| a-C:H Surface layer: | |
|---|---|
| $CH_4$ | 200 ml/min (normal) |
| Power | (G) 200 W, (H) 2,000 W |
| Discharge space pressure | 53 Pa |
| Substrate temperature | 50° C. |
| Layer thickness | 0.3 μm |

Comparative Example 2

Using the apparatus for producing the a-Si photosensitive member by RF plasma-assisted CVD as shown in FIG. 2, a lower-part blocking layer, a photoconductive layer and a buffer layer were superposingly formed on a mirror-finished aluminum cylinder under the same conditions as those shown in Example 1. A surface layer comprised of a-Sic was further superposingly formed thereon under forming conditions shown below, to produce an a-Si photosensitive member. Here, the frequency of RF power used was 13.56 MHz. The other conditions were the same as those in Example 1. On this a-Si photosensitive member thus obtained, evaluation was made in the same manner as in Example 1.

| a-SiC Surface layer: | |
|---|---|
| $CH_4$ | 50 ml/min (normal) |
| $SiH_4$ | 500 ml/min (normal) |
| Power | 200 W |
| Discharge space pressure | 53 Pa |
| Substrate temperature | 300° C. |
| Layer thickness | 0.3 μm |

The results of Example 1 and Comparative Examples 1 and 2 are shown in Table 1. As can be seen from the results shown in Table 1, very good and high-quality images are stably obtainable when the photosensitive member having the a-C:H surface layer, the contact charging and the polymerization toner are employed in combination.

TABLE 1

| | Example 1 | | | | | | Comparative Example 1 | | Comparative Example 2 |
|---|---|---|---|---|---|---|---|---|---|
| Photosensitive member: | (A) | (B) | (C) | (D) | (E) | (F) | (G) | (H) | a-SiC |
| Dynamic hardness: (Pa) | $5.00 \times 10^9$ | $7.06 \times 10^9$ | $1.04 \times 10^{10}$ | $1.30 \times 10^{10}$ | $1.51 \times 10^{10}$ | $1.74 \times 10^{10}$ | $4.02 \times 10^9$ | $1.86 \times 10^{10}$ | $5.29 \times 10^9$ |
| Abrasion level: | B | A | A | A | A | A | C | A | D |
| Coarse images: | A | A | A | A | A | A | C | A | C |
| Halftone unevenness: | A | A | A | A | A | A | A | A | A |
| Fine-line reproducibility: | A | A | A | A | A | A | A | A | C |
| Image resolution: | A | A | A | A | A | A | A | A | C |
| Adherence: | A | A | A | A | A | B | A | C | A |
| Hydrogen content: (atomic %) | 56% | 56% | 52% | 48% | 44% | 42% | 58% | 41% | 46% |

Example 2

—Production of Photosensitive Member— a-Si Photosensitive members (A) to (F) having surface layers with different dynamic hardness were produced in the same manner as in Example 1.

—Production of Toner—

Next, polymerization toner (2) was produced in the following way.

First, toner particles having a weight-average particle diameter of 6.4 μm were obtained in the same manner as the polymerization toner (1). Then, 100 parts of the toner particles thus obtained, 1.2 parts of hydrophobic fine silica powder obtained by surface-treating silica of 8 nm in primary particle diameter with hexamethyldisilazane and thereafter with silicone oil and having a BET specific surface area of 150 $mm^2/g$ after the treatment, and 2 parts of conductive fine powder comprised of zinc oxide were mixed by means of a Henschel mixer (manufactured by Mitsui Miike Engineering Corporation) to prepare the polymerization toner (2). The toner thus obtained had an average circularity of 0.983 and an intensity of magnetization (saturation magnetization) under application of a magnetic field of 79.6 kA/m, of 28 $Am^2/kg$.

The conductive fine powder comprised of zinc oxide which was used here comprises fine particles (resistivity: 1,500Ω·cm; transmittance: 35%) having a volume-average particle diameter of 1.5 μm and containing 35% by volume of particles of 0.5 μm or smaller and 0% by number of particles of 5 μm or larger in particle size distribution, obtained by subjecting zinc oxide primary particles of 0.1 to 0.3 μm in primary-particle diameter to granulation under pressure and the resultant particles to air classification. Observation of this fine zinc oxide powder on a scanning electron microscope at 3,000 magnifications and 30,000 magnifications revealed that it was comprised of zinc oxide primary particles of 0.1 to 0.3 μm in diameter and agglomerates of 1 to 4 μm in diameter.

—Image-Forming Apparatus—

The a-Si photosensitive member and polymerization toner (2) produced in the manner described above were set in the electrophotographic apparatus shown in FIG. 7, making use of the elastic-roller charging assembly having the conductive fine powder interposed at the contact zone as shown in FIG. 5 (however, the cleaner 707 was detached). Here, the process speed was set at 400 mm/s; and the relative speed of the photosensitive member to the elastic roller, 200% in opposite direction.

Evaluation was made on the photosensitive members (A) to (F) in the same manner as in Example 1.

Comparative Example 3 a-Si Photosensitive members (G) and (H) having surface layers with different dynamic hardness were produced in the same manner as in Comparative Example 1.

On the photosensitive members (G) and (H) thus obtained, evaluation was made in the same manner as in Example 2.

Comparative Example 4

An a-Si photosensitive member in which a surface layer comprised of a-SiC was superposingly formed was produced in the same manner as in Comparative Example 2. On the photosensitive member thus obtained, evaluation was made in the same manner as in Example 2.

The results of Example 2 and Comparative Examples 3 and 4 are shown in Table 2. As can be seen from the results shown in Table 2, very good and high-quality images are stably obtainable in the present invention also in the case of the image-forming apparatus making use of the elastic-roller charging assembly having the conductive fine powder interposed at the contact zone.

TABLE 2

| | Example 2 | | | | | | Comparative Example 3 | | Comparative Example 4 |
|---|---|---|---|---|---|---|---|---|---|
| Photosensitive member | (A) | (B) | (C) | (D) | (E) | (F) | (G) | (H) | a-SiC |
| Dynamic hardness: (Pa) | $5.00 \times 10^9$ | $7.06 \times 10^9$ | $1.04 \times 10^{10}$ | $1.30 \times 10^{10}$ | $1.51 \times 10^{10}$ | $1.74 \times 10^{10}$ | $4.02 \times 10^9$ | $1.86 \times 10^{10}$ | $5.29 \times 10^9$ |
| Abrasion level: | B | A | A | A | A | A | C | A | D |
| Coarse images: | A | A | A | A | A | A | C | A | C |
| Halftone unevenness: | A | A | A | A | A | A | A | A | A |
| Fine-line reproducibility: | A | A | A | A | A | A | A | A | C |
| Image resolution: | A | A | A | A | A | A | A | A | C |
| Adherence: | A | A | A | A | A | B | A | C | A |

Example 3

—Production of Photosensitive Member—

Using the apparatus for producing the a-Si photosensitive member by RF plasma-assisted CVD as shown in FIG. 2, a lower-part blocking layer, a photoconductive layer and a buffer layer were superposingly formed on a mirror-finished aluminum cylinder under the same conditions as those shown in Example 1. A surface layer comprised of a-C:H was further superposingly formed thereon under forming conditions shown below, to produce an a-Si photosensitive member. Here, the frequency of RF power used was 13.56 MHz.

| a-C:H Surface layer: | |
|---|---|
| $CH_4$ | 100 ml/min (normal) |
| $H_2$ | 400 ml/min (normal) |
| Power | 800 W |
| Discharge space pressure | 13 Pa |
| Substrate temperature | 150° C. |
| Layer thickness | 0.3 μm |

—Production of Toner—

Next, polymerization toner (3) was produced in the following way.

First, toner particles having a weight-average particle diameter of 6.4 μm were obtained in the same manner as the polymerization toner (1). Then, 100 parts of the toner particles thus obtained, 1.2 parts of hydrophobic fine silica powder obtained by treating silica of 12 nm in primary particle diameter with hexamethyldisilazane and thereafter with silicone oil and having a BET specific surface area of 140 $mm^2/g$ after the treatment, and 2 parts of fine zinc oxide powder were mixed by means of a Henschel mixer (manufactured by Mitsui Miike Engineering Corporation) to prepare the polymerization toner (3).

—Image-Forming Apparatus—

The a-Si photosensitive member and polymerization toner (3) produced in the manner described above were set in the electrophotographic apparatus shown in FIG. 7, making use of the elastic-roller charging assembly having the conductive fine powder interposed at the contact zone as shown in FIG. 5 (however, the cleaner 707 was detached). Here, the process speed was set at 350 mm/s; and the relative speed of the photosensitive member to the elastic roller, 180% in opposite direction.

Evaluation was made in the same manner as in Example 1.

Comparative Example 5

—Production of Photosensitive Member—

An a-Si photosensitive member in which a surface layer comprised of a-C:H was superposingly formed was produced in the same manner as in Example 3.

—Production of Toner—

Next, pulverization toner (1) was produced in the following way.

| | |
|---|---|
| Styrene/n-butyl acrylate copolymer (weight ratio: 80/20) | 100 parts |
| Unsaturated polyester resin | 2 parts |
| Saturated polyester resin | 3 parts |
| Negative charge control agent (monoazo dye type Fe compound) | 1 part |
| Surface hydrophobic-treated magnetic material | 90 parts |
| Ester wax (maximum value of endothermic peak in DSC: 72° C.) | 5 parts |

The above materials were mixed by means of a blender, and then melt-kneaded by means of a twin-screw extruder heated to 110° C. The kneaded product cooled was crushed using a hammer mill, and the crushed product was finely pulverized by means of a jet mill. Thereafter, the finely pulverized product thus obtained was air-classified to obtain black particles with a weight average particle diameter of 8.9 $\mu$m.

100 parts of the black particles thus obtained, 0.9 part of hydrophobic fine silica powder having been treated with hexamethyldisilazane and thereafter with silicone oil and having a BET specific surface area of 180 $mm^2/g$ after the treatment, and 2 parts of fine zinc oxide powder were mixed by means of a Henschel mixer (manufactured by Mitsui Miike Engineering Corporation) to prepare the pulverization toner (1). The toner thus obtained had an average circularity of 0.946.

—Image-Forming Apparatus—

The a-Si photosensitive member and pulverization toner (1) produced in the manner described above were set in the electrophotographic apparatus shown in FIG. 7, making use of the elastic-roller charging assembly having the conductive fine powder interposed at the contact zone as shown in FIG. 5 (however, the cleaner 707 was detached). Here, the process speed was set at 350 mm/s; and the relative speed of the photosensitive member to the elastic roller, 180% in opposite direction.

Evaluation was made in the same manner as in Example 1.

The results of Example 3 and Comparative Example 5 are shown in Table 3. As can be seen from the results shown in Table 3, very good and high-quality images are obtainable when a spherical toner is used as the toner.

TABLE 3

| | Example 3 | Comparative Example 5 |
|---|---|---|
| Dynamic hardness: (Pa) | $1.02 \times 10^{10}$ | $1.02 \times 10^{10}$ |
| Abrasion level: | A | A |
| Coarse images: | A | A |
| Halftone unevenness: | A | A |
| Fine-line reproducibility: | A | B |
| Image resolution: | A | B |
| Adherence: | A | A |
| Hydrogen content: | 48 atomic % | 48 atomic % |

Example 4

A photosensitive member in which a surface layer comprised of a-C:H was superposingly formed was produced in the same manner as in Example 3. The a-Si photosensitive member was used in combination with the polymerization toner (1), which were set in the image-forming apparatus shown in FIG. 7, in which the magnetic-brush charging assembly shown in FIG. 4 was used. Here, the process speed was set at 300 mm/s; and the relative speed of the photosensitive member to the magnetic brush, 150% in opposite direction.

In the present Example, an A4-size paper 50,000-sheet running test was made. The quantity of the magnetic particles of the magnetic-brush charging assembly was measured before and after the running test to examine the quantity of leaked particles. Evaluation was made according to the following criteria.

A: The rate of decrease of magnetic particles is less than 2%; very good.

B: The rate of decrease of magnetic particles is 2% or more to less than 5%; good.

C: The rate of decrease of magnetic particles is 5% or more to less than 10%, and no problem in practical use.

D: The rate of decrease of magnetic particles is 10% or more.

Comparative Example 6

A photosensitive member in which a surface layer comprised of a-SiC was superposingly formed was produced in the same manner as in Comparative Example 2. On the photosensitive member thus obtained, evaluation was made in the same manner as in Example 4.

The results of Example 4 and Comparative Example 6 are shown in Table 4. As can be seen from the results shown in Table 4, the magnetic particles can be kept from leaking and the charging assembly can have a longer lifetime when the photosensitive member having the a-C:H surface layer is combined with contact charging.

TABLE 4

| | Example 4 | Comparative Example 6 |
|---|---|---|
| Quantity of magnetic particles leaked: | A | C |

Example 5

A photosensitive member in which a surface layer comprised of a-C:H was superposingly formed was produced in the same manner as in Example 3. The a-Si photosensitive member was used in combination with the polymerization toner (3), which were set in the image-forming apparatus shown in FIG. 7, making use of the elastic-roller charging assembly having the conductive fine powder interposed at the contact zone as shown in FIG. 5 (however, the cleaner 707 was detached). Here, the process speed was set at 350 mm/s; and the relative speed of the photosensitive member to the elastic roller, 220% in opposite direction.

In the present Example, an A4-size paper 100,000-sheet running test was made. The outer diameter of the elastic roller was measured before and after the running test to examine its wear level. Evaluation was made according to the following criteria.

A: The rate of decrease in outer diameter is less than 2%; very good.

B: The rate of decrease in outer diameter is 2% or more to less than 5%; good.

C: The rate of decrease in outer diameter is 5% or more to less than 10%, and no problem in practical use.

D: The rate of decrease in outer diameter is 10% or more.

Comparative Example 7

A photosensitive member in which a surface layer comprised of a-SiC was superposingly formed was produced in the same manner as in Comparative Example 2. On the photosensitive member thus obtained, evaluation was made in the same manner as in Example 5.

The results of Example 5 and Comparative Example 7 are shown in Table 5. As can be seen from the results shown in Table 5, the elastic roller can be kept from wearing and the charging assembly can have a longer lifetime when the photosensitive member having the a-C:H surface layer is combined with contact charging.

TABLE 5

| | Example 5 | Comparative Example 7 |
|---|---|---|
| Elastic roller wear level: | A | C |

Example 6

Using the apparatus for producing the a-Si photosensitive member by VHF plasma-assisted CVD as shown in FIG. 3, a lower-part blocking layer, a photoconductive layer, a buffer layer and an a-C:H surface layer were superposingly formed on a mirror-finished aluminum cylinder under conditions shown below, to produce a-Si photosensitive members. Here, the frequency of VHF power used was 105 MHz.

| | |
|---|---|
| (1) Lower-part blocking layer: | |
| $SiH_4$ | 200 ml/min (normal) |
| $H_2$ | 400 ml/min (normal) |
| NO | 10 ml/min (normal) |
| $PH_3$ | 2,000 ppm (based on $SiH_4$) |
| Power | 1,200 W |
| Discharge space pressure | 0.8 Pa |
| Substrate temperature | 250° C. |
| Layer thickness | 2 μm |
| (2) Photoconductive layer: | |
| $SiH_4$ | 200 ml/min (normal) |
| $H_2$ | 400 ml/min (normal) |
| Power | 1,200 W |
| Discharge space pressure | 0.8 Pa |
| Substrate temperature | 250° C. |
| Layer thickness | 30 μm |
| (3) Buffer layer: | |
| $SiH_4$ | 20 ml/min (normal) |
| $CH_4$ | 50 ml/min (normal) |
| Power | 600 W |
| Discharge space pressure | 0.8 Pa |
| Substrate temperature | 250° C. |
| Layer thickness | 0.3 μm |
| (4) Surface layer: | |
| $CH_4$ | 100 ml/min (normal) |
| Power | 1,800 W |
| Discharge space pressure | 0.8 Pa |
| Substrate temperature | 200° C. |
| Layer thickness | 0.5 μm |

The photosensitive member thus produced was set in the electrophotographic apparatus shown in FIG. 7, making use of the elastic-roller charging assembly shown in FIG. 6, having the conductive fine powder interposed at the contact zone. This was used in combination with the polymerization toner (1) to make evaluation in the same manner as in Example 1. The charging means shown in FIG. 6 is so constructed that the conductive fine powder 505 is supplied by the replenishing unit 508 provided at the upper part of the elastic-roller charging assembly.

The results of evaluation are shown in Table 6. As can be seen from the results shown in Table 6, the present invention is likewise effective also when the the a-Si photosensitive member produced by VHF plasma-assisted CVD is used.

TABLE 6

| | Example 6 |
|---|---|
| Dynamic hardness: (Pa) | $1.60 \times 10^{10}$ |
| Abrasion level: | A |
| Coarse images: | A |
| Halftone unevenness: | A |
| Fine-line reproducibility: | A |
| Image resolution: | A |
| Adherence: | A |
| Hydrogen content: | 50 atomic % |

What is claimed is:

1. An image-forming apparatus comprising:

an electrophotographic photosensitive member having a conductive substrate, and at least a photoconductive layer and a surface layer on the conductive substrate;

a charging means for charging the electrophotographic photosensitive member electrostatically;

a latent-image-forming means for performing imagewise exposure to form an electrostatic latent image on the electrophotographic photosensitive member;

a developing means for moving a toner to the electrostatic latent image formed on the electrophotographic photosensitive member, to render the electrostatic latent image visible to form a toner image; and a transfer means for transferring the toner image to a transfer medium;

wherein;

the photoconductive layer of said electrophotographic photosensitive member comprises a non-single-crystal material composed chiefly of silicon;

the surface layer of said electrophotographic photosensitive member comprises a non-single-crystal carbon film containing at least hydrogen, and has a dynamic hardness in the range of from $4.90\times10^9$ to $1.76\times10^{10}$ Pa (500 to 1,800 kgf /mm$^2$ ) ;

said charging means has a charging member kept in contact with said electrophotographic photosensitive member, forming a contact zone therewith, and is a charging means for charging said electrophotographic photosensitive member electrostatically upon application of a voltage; and said toner is a magnetic toner having toner particles containing at least a binder resin and a magnetic material, and an inorganic fine powder, and having an average circularity of from 0.950 to 1.000;

said toner having a saturation magnetization of from 10 to 50 Am$^2$/kg (emu/g) under application of a magnetic field of 79.6 kA/m (1,000 oersteds).

2. The image-forming apparatus according to claim 1, wherein said surface layer of said electrophotographic photosensitive member has a dynamic hardness in the range of from $6.86\times10^9$ to $1.47\times10^{10}$ Pa (700 to 1,500 kgf/mm$^2$ ).

3. The image-forming apparatus according to claim 1, wherein said photosensitive layer of said electrophotographic photosensitive member contains at least one element selected from the group consisting of hydrogen and a halogen.

4. The image-forming apparatus according to claim 1, wherein said non-single-crystal carbon film has a hydrogen content of from 41 atomic % to 60 atomic % based on the total weight of the carbon film.

5. The image-forming apparatus according to claim 1, wherein said electrophotographic photosensitive member is provided with a buffer layer between the photosensitive layer and the surface layer;

said buffer layer comprising a non-single-crystal material composed chiefly of silicon, containing at least one element selected from the group consisting of hydrogen and a halogen, and further contains at least one atom selected from the group consisting of carbon, oxygen and nitrogen.

6. The image-forming apparatus according to claim 5, wherein said buffer layer further contains at least one atom of atoms belonging to Group 3B and Group 5B of the periodic table.

7. The image-forming apparatus according to claim 1, wherein said surface layer is a layer formed by deposition carried out by decomposing at least a hydrocarbon gas by plasma-assisted chemical vapor deposition making use of a high frequency of from 1 MHz to 450 MHz.

8. The image-forming apparatus according to claim 1, wherein said surface layer is a layer formed by deposition carried out by decomposing at least a hydrocarbon gas by plasma-assisted chemical vapor deposition making use of a high frequency of 13.56 MHz or 105 MHz.

9. The image-forming apparatus according to claim 1, wherein said charging member is to perform charging by means of a magnetic brush formed by magnetically binding magnetic particles.

10. The image-forming apparatus according to claim 9, wherein said magnetic particles have a volume-average particle diameter of from 10 $\mu$m to 50 $\mu$m.

11. The image-forming apparatus according to claim 9, wherein said magnetic particles have a volume resistivity of from $1\times10^4\Omega\cdot$cm to $1\times10^9\Omega\cdot$cm.

12. The image-forming apparatus according to claim 9, wherein said magnetic particles have surface layers on their surfaces.

13. The image-forming apparatus according to claim 1, wherein in said charging means a conductive fine powder is to be interposed at the part of contact between said electrophotographic photosensitive member and said charging member.

14. The image-forming apparatus according to claim 13, wherein said magnetic toner has a conductive fine powder on its particle surfaces, and the conductive fine powder adheres to said electrophotographic photosensitive member when the toner image is formed on said electrophotographic photosensitive member, remains on said electrophotographic photosensitive member after the toner image has been transferred to the transfer medium, and is carried thereon to reach said charging means.

15. The image-forming apparatus according to claim 13, wherein said charging means has a conductive fine powder replenishing means which holds said conductive fine powder therein and feeds said conductive fine powder to the surface of the charging member.

16. The image-forming apparatus according to claim 13, wherein said conductive fine powder has a resistivity of $1\times10^9\Omega\cdot$cm or lower.

17. The image-forming apparatus according to claim 1, wherein said charging member is an elastic body having a porous-material surface.

18. The image-forming apparatus according to claim 1, wherein said charging member is a roller member having an Asker-C hardness of 50 degrees or less.

19. The image-forming apparatus according to claim 1, wherein said charging member is a roller member having an Asker-C hardness of from 25 degrees to 50 degrees.

20. The image-forming apparatus according to claim 1, wherein said charging member is a roller member having a volume resistivity of from $1\times10^3\Omega\cdot$cm to $1\times10^8\Omega\cdot$cm.

21. The image-forming apparatus according to claim 1, wherein said developing means serves also as a cleaning means which collects transfer residual toner having remained on the surface of said electrophotographic photosensitive member.

22. The image-forming apparatus according to claim 1, wherein said charging means is to charge said electrophotographic photosensitive member, keeping a difference in relative speed between the movement speed of the surface of said charging member and the movement speed of the surface of said electrophotographic photosensitive member at the part of contact between them.

23. The image-forming apparatus according to claim 1, wherein said charging member is to charge said electrophotographic photosensitive member while said charging member and said electrophotographic photosensitive member move in the direction opposite to each other at the part of contact between them.

24. The image-forming apparatus according to claim 1, wherein said toner has an average circularity of from 0.950 to 0.995.

25. The image-forming apparatus according to claim 1, wherein the inorganic fine powder contained in said toner has been hydrophobic-treated.

26. The image-forming apparatus according to claim 1, wherein the inorganic fine powder contained in said toner has been hydrophobic-treated with a silicone oil.

27. An image-forming method comprising:

a charging step of electrostatically charging an electrophotographic photosensitive member having a conductive substrate, and at least a photoconductive layer and a surface layer on the conductive substrate;

a latent-image-forming step of performing imagewise exposure to form an electrostatic latent image on the electrophotographic photosensitive member;

a developing step of moving a toner to the electrostatic latent image formed on the electrophotographic photosensitive member, to render the electrostatic latent image visible to form a toner image; and a transfer step of transferring the toner image to a transfer medium;

wherein;

the photoconductive layer of said electrophotographic photosensitive member comprises a non-single-crystal material composed chiefly of silicon;

the surface layer of said electrophotographic photosensitive member comprises a non-single-crystal carbon film containing at least hydrogen, and has a dynamic hardness in the range of from $4.90\times10^9$ to $1.76\times10^{10}$ Pa (500 to 1,800 kgf/mm$^2$);

said charging step is a charging step of applying a voltage to a charging member kept in contact with said electrophotographic photosensitive member, forming a contact zone therewith, to charge said electrophotographic photosensitive member electrostatically; and said toner is a magnetic toner having toner particles containing at least a binder resin and a magnetic material, and an inorganic fine powder, and having an average circularity of from 0.950 to 1.000;

said toner having a saturation magnetization of from 10 to 50 Am$^2$/kg (emu/g) under application of a magnetic field of 79.6 kA/m (1,000 oersteds).

* * * * *

UNITED STATES PATENT AND TRADEMARK OFFICE

CERTIFICATE OF CORRECTION

PATENT NO. : 6,576,387 B2
DATED : June 10, 2003
INVENTOR(S) : Junichiro Hashizume et al.

It is certified that error appears in the above-identified patent and that said Letters Patent is hereby corrected as shown below:

Column 1,
Line 20, "with." should read -- with, --;
Line 42, "used," should read -- use, --;
Line 52, "that." should read -- that, --; and
Line 57, "tends" should read -- tend --.

Column 2,
Line 15, "manners." should read -- manners, --;
Line 34, "diameter," should read -- diameter. --;
Line 47, "is" should read -- are --; and
Line 65, "areas." should read -- areas, --.

Column 3,
Line 10, "period" should read -- period of --.

Column 5,
Line 59, "be" should read -- is --.

Column 6,
Line 36, "bruch" should read -- brush --; and
Line 41, "less deteriorate." should read -- deteriorate less. --.

Column 10,
Line 20, "surf ace" should read -- surface --.

Column 12,
Line 21, "Layer" should read -- Layers --; and
Line 51, "hoater" should read -- heater --.

Column 14,
Line 42, "magnetic-brush" (second occurrence) should read -- magnetic brush --.

Column 15,
Line 35, "plain" should read -- plane --; and
Line 51, "cross" should read -- across --.

UNITED STATES PATENT AND TRADEMARK OFFICE

CERTIFICATE OF CORRECTION

PATENT NO. : 6,576,387 B2
DATED : June 10, 2003
INVENTOR(S) : Junichiro Hashizume et al.

It is certified that error appears in the above-identified patent and that said Letters Patent is hereby corrected as shown below:

Column 21,
Line 22, "$\mu$m," should read -- $\mu$m. --.

Column 22,
Line 22, "mean" should read -- means --.

Column 28,
Line 13, "compound" should read -- compounds --; and
Line 17, "Inorganic" should read -- inorganic --.

Column 29,
Line 44, "causeed" should read -- caused --.

Column 42,
Line 32, "wherein;" should read -- wherein, --; and
Line 41, "1,800 kgf /mm$^2$ );" should read -- 1,800 kgf/mm$^2$); --.

Column 44,
Line 44, "wherein;" should read -- wherein, --.

Signed and Sealed this

First Day of June, 2004

JON W. DUDAS
*Acting Director of the United States Patent and Trademark Office*